US007530877B1

(12) United States Patent
Moore et al.

(10) Patent No.: US 7,530,877 B1
(45) Date of Patent: May 12, 2009

(54) SEMICONDUCTOR PROCESSOR SYSTEMS, A SYSTEM CONFIGURED TO PROVIDE A SEMICONDUCTOR WORKPIECE PROCESS FLUID

(75) Inventors: Scott E. Moore, Meridian, ID (US); Scott G. Meikle, Gainesville, VA (US); Magdel Crum, Portland, OR (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/517,127

(22) Filed: Mar. 2, 2000

Related U.S. Application Data

(63) Continuation-in-part of application No. 09/324,737, filed on Jun. 3, 1999, now Pat. No. 6,290,576.

(51) Int. Cl.
*B24B 49/00* (2006.01)
*B24B 51/00* (2006.01)

(52) U.S. Cl. ..... 451/5; 451/8; 451/67

(58) Field of Classification Search ..... 451/5, 451/8, 9, 10, 60, 65, 67, 87, 88, 89, 446, 451/451, 453, 456
See application file for complete search history.

(56) References Cited

U.S. PATENT DOCUMENTS 3,441,737 A 4/1969 Topol
3,612,688 A 10/1971 Liskowitz
3,653,767 A 4/1972 Liskowitz
3,695,763 A 10/1972 Shiuh
3,713,743 A 1/1973 Simms
3,809,243 A * 5/1974 Teders ..... 210/96.1
4,152,070 A 5/1979 Kushner et al.
4,263,511 A 4/1981 Hirschberg
4,282,745 A 8/1981 Burr
4,320,978 A 3/1982 Sato
4,390,283 A 6/1983 Meyer
4,441,960 A 4/1984 Karnis et al.
4,457,624 A 7/1984 Goldberg et al.
4,730,922 A 3/1988 Bach et al.
4,874,243 A 10/1989 Perren
4,906,101 A 3/1990 Lin et al.
4,964,728 A 10/1990 Kloth et al.

(Continued)

OTHER PUBLICATIONS

"The Science and Engineering of Microelectronic Fabrication"; Campbell, Stephen A.; *Oxford University Press*; 1996; pp. 253-257.

(Continued)

*Primary Examiner*—Timothy V Eley
(74) *Attorney, Agent, or Firm*—Wells St. John, P.S.

(57) ABSTRACT

Semiconductor processor systems, systems configured to provide a semiconductor workpiece process fluid, semiconductor workpiece processing methods, methods of preparing semiconductor workpiece process fluid, and methods of delivering semiconductor workpiece process fluid to a semiconductor processor are provided. One aspect of the invention provides a semiconductor processor system including a process chamber adapted to process at least one semiconductor workpiece using a process fluid; a connection coupled with the process chamber and configured to receive the process fluid; a sensor coupled with the connection and configured to output a signal indicative of the process fluid; and a control system coupled with the sensor and configured to control at least one operation of the semiconductor processor system responsive to the signal.

53 Claims, 20 Drawing Sheets

U.S. PATENT DOCUMENTS 4,990,346 A 2/1991 Strippler et al.
5,059,811 A 10/1991 King
5,085,831 A 2/1992 Hickey et al.
5,172,332 A 12/1992 Hungerford et al.
5,194,921 A 3/1993 Tambo et al.
5,207,921 A * 5/1993 Vincent ..... 210/704
5,446,531 A 8/1995 Boyer et al.
5,555,583 A 9/1996 Berkcan
5,653,624 A 8/1997 Ishikawa et al.
5,664,990 A 9/1997 Adams et al.
5,718,620 A * 2/1998 Tanaka et al. ..... 451/288
5,750,440 A 5/1998 Vanell et al.
5,755,614 A 5/1998 Adams et al.
5,791,970 A 8/1998 Yueh
5,828,458 A 10/1998 Taylor et al.
5,836,805 A 11/1998 Obeng
5,865,665 A 2/1999 Yueh
5,881,578 A 3/1999 Proppe et al.
5,885,134 A * 3/1999 Shibata et al. ..... 451/41
5,912,737 A 6/1999 Bannerjee et al.
5,923,433 A 7/1999 Giuffre et al.
6,048,256 A 4/2000 Obeng et al.
6,066,030 A 5/2000 Uzoh
6,077,147 A 6/2000 Yang et al.
6,096,185 A 8/2000 Corlett et al.
6,099,386 A * 8/2000 Tsai et al. ..... 451/8
6,100,976 A 8/2000 Ackerson
6,136,043 A * 10/2000 Robinson et al. ..... 8/485
6,159,082 A * 12/2000 Sugiyama et al. ..... 451/285
6,165,048 A * 12/2000 Russ et al. ..... 451/5
6,183,352 B1 * 2/2001 Kurisawa ..... 451/87
6,184,983 B1 2/2001 Yamaguchi et al.
6,290,576 B1 9/2001 Moore et al.
6,307,630 B1 10/2001 Banerjee
6,319,469 B1 11/2001 Mian et al.
6,379,538 B1 * 4/2002 Corlett et al. ..... 210/96.1
6,409,936 B1 * 6/2002 Robinson et al. ..... 252/79.1
6,482,325 B1 * 11/2002 Corlett et al. ..... 210/662
6,567,166 B2 5/2003 Ottens et al.

OTHER PUBLICATIONS http://www.intratechnology.com/html/sensors.htm, Intra Technology, *Sensore*, Mar. 25, 1999, 2 pages.
http://www.ftsinc.com/complete/analite/analite.htm, FTS, *Analite-SDI Turbidity Sensor*, Mar. 25, 1999, 1 page.
http://www.customsensors.com/optimax.htm, Custom Sensors & Technology, *OptiMax 6000 Series Process Photometric Analyzers*, Mar. 25, 1999, 2 pages.
http://www.reflectronics.com/reflectronics_inc_contents.htm, Reflectronics, Inc., *Fiber Optic Backscatter Sensor*, Mar. 25, 1999, 1 page.
http://www.honeywell.com/sensing/prodinfo/turbidity/technical/turbidity.st, Gary O'Brien, Honeywell, *Turbidity Sensor for Electromechanical Dishwasher Control*, 1998-1999, 11 pages.
http://www.impomag.com/O_automa/1097O064.htm, ABB Instrumentation, The Stockroom, *Photodiode Sensor*, 1999, 1 page.

* cited by examiner

SEMICONDUCTOR PROCESSOR SYSTEMS, A SYSTEM CONFIGURED TO PROVIDE A SEMICONDUCTOR WORKPIECE PROCESS FLUID

RELATED PATENT DATA

The present application is a continuation-in-part of patent application Ser. No. 09/324,737 which was filed on Jun. 3, 1999 now U.S. Pat. No. 6,290,576 and which is incorporated by reference herein.

TECHNICAL FIELD

The present invention relates to semiconductor processor systems, systems configured to provide a semiconductor workpiece process fluid, semiconductor workpiece processing methods, methods of preparing semiconductor workpiece process fluid, and methods of delivering semiconductor workpiece process fluid to a semiconductor processor.

BACKGROUND OF THE INVENTION

Numerous semiconductor processing tools are typically utilized during the fabrication of semiconductor devices. One such common semiconductor processor is a chemical-mechanical polishing (CMP) processor. A chemical-mechanical polishing processor is typically used to polish or planarize the front face or device side of a semiconductor wafer. Numerous polishing steps utilizing the chemical-mechanical polishing system can be implemented during the fabrication or processing of a single wafer.

In an exemplary chemical-mechanical polishing apparatus, a semiconductor wafer is rotated against a rotating polishing pad while an abrasive and chemically reactive solution, also referred to as a slurry, is supplied to the rotating pad. Further details of chemical-mechanical polishing are described in U.S. Pat. No. 5,755,614, incorporated herein by reference.

A number of polishing parameters affect the processing of a semiconductor wafer. Exemplary polishing parameters of a semiconductor wafer include downward pressure upon a semiconductor wafer, rotational speed of a carrier, speed of a polishing pad, flow rate of slurry, and pH of the slurry.

Slurries used for chemical-mechanical polishing may be divided into three categories including silicon polish slurries, oxide polish slurries and metals polish slurries. A silicon polish slurry is designed to polish and planarize bare silicon wafers. The silicon polish slurry can include a proportion of particles in a slurry typically with a range from 1-15 percent by weight.

An oxide polish slurry may be utilized for polishing and planarization of a dielectric layer formed upon a semiconductor wafer. Oxide polish slurries typically have a proportion of particles in the slurry within a range of 1-15 percent by weight. Conductive layers upon a semiconductor wafer may be polished and planarized using chemical-mechanical polishing and a metals polish slurry. A proportion of particles in a metals polish slurry may be within a range of 1-5 percent by weight.

It has been observed that slurries can undergo chemical changes during polishing processes. Such changes can include composition and pH, for example. Furthermore, polishing can produce stray particles from the semiconductor wafer, pad material or elsewhere. Polishing may be adversely affected once these by-products reach a sufficient concentration. Thereafter, the slurry is typically removed from the chemical-mechanical polishing processing tool.

It is important to know the status of a slurry being utilized to process semiconductor wafers inasmuch as the performance of a semiconductor processor is greatly impacted by the slurry. Such information can indicate proper times for flushing or draining the currently used slurry.

SUMMARY OF THE INVENTION

The present invention relates to semiconductor processor systems, systems configured to provide a semiconductor workpiece process fluid, semiconductor workpiece processing methods, methods of preparing semiconductor workpiece process fluid, and methods of delivering semiconductor workpiece process fluid to a semiconductor processor.

According to certain aspects of the present invention, a control system is configured to monitor a process fluid within a semiconductor processor system. The control system is configured to control operations of the semiconductor processor system responsive to such monitoring of the process fluid.

One aspect of the present invention provides a mixing system configured to mix plural components to form a process fluid. The disclosed control system is configured to monitor and control such mixing operations. The semiconductor processor system also provides a sampling system according to other aspects of the invention. The sampling system is configured to draw and monitor samples of a process fluid. Another aspect of the invention provides a flush system and recirculation system configured to respectively flush and recirculate fluid within an associated connection of the semiconductor processor system. Additional aspects of the invention provide monitoring of a connection for accumulation of particulate matter. The disclosed control system monitors such accumulation and implements responsive operations.

The present invention provides additional structure and methods as disclosed below.

BRIEF DESCRIPTION OF THE DRAWINGS

Preferred embodiments of the invention are described below with reference to the following accompanying drawings.

FIG. 9 is a schematic diagram illustrating circuitry of the sensor configuration shown in FIG. 6.

FIG. 14 is an illustrative representation of an exemplary process chamber of a semiconductor processor.

FIG. 15 is a functional block diagram of an exemplary control system of the semiconductor processor system.

FIG. 16 is a functional block diagram of an exemplary mixing system of the semiconductor processor system.

FIG. 17 is a graphical representation of precipitation of particulate matter within a process fluid having no surfactants.

FIG. 18 is a graphical representation of precipitation of particulate matter within a process fluid having a surfactant.

FIG. 21 is a functional representation of an exemplary flush system of the semiconductor processor system.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
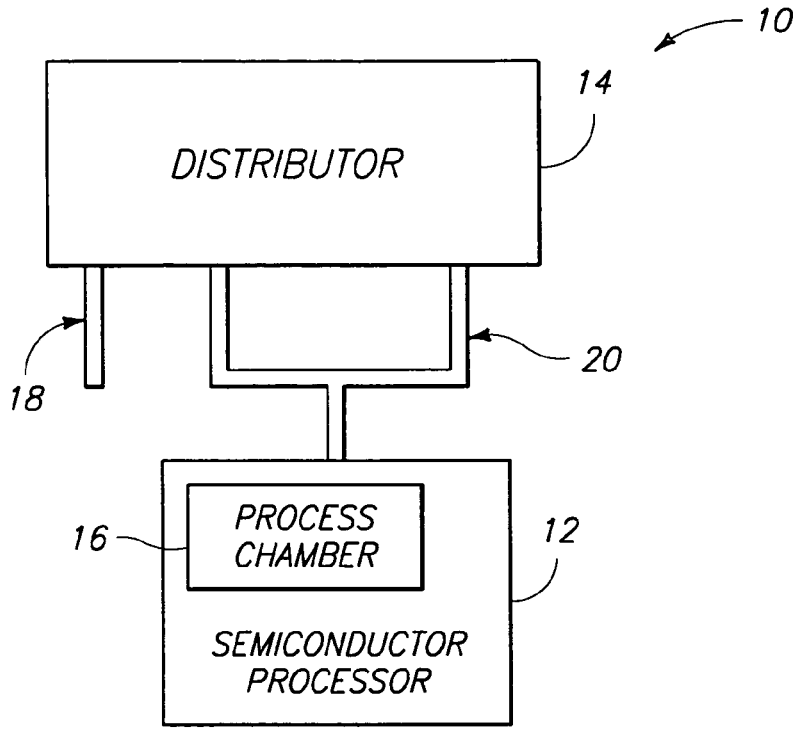
FIG. 1 is an illustrative representation of a slurry distributor and semiconductor processor.

Referring to FIG. 1, a semiconductor processing system 10 is illustrated. The depicted semiconductor processing system 10 includes a semiconductor processor 12 coupled with a distributor 14. Semiconductor processor 12 includes a process chamber 16 configured to receive a semiconductor workpiece, such as a silicon wafer. In an exemplary configuration, semiconductor processor 12 is implemented as a chemical-mechanical polishing processing tool.

Distributor 14 is configured to supply a subject material for use in semiconductor workpiece processing operations. For example, distributor 14 can supply a subject material comprising a slurry to semiconductor processor 12 for chemical-mechanical polishing applications.

Exemplary conduits or piping of semiconductor processing system 10 are shown in FIG. 1. In the depicted configuration, a static route 18 and a dynamic route 20 are provided. Further details of static route 18 and dynamic route 20 are described below with reference to FIGS. 2 and 3, respectively. In general, static route 18 is utilized to provide monitoring of the subject material of distributor 14 in a substantially static state. Such provides real-time information regarding the subject material being utilized within semiconductor processing system 10. Dynamic route 20 comprises a recirculation and distribution line in one configuration. In addition, subject material can be supplied to semiconductor processor 12 via dynamic route 20.

Distributor 14 can include an internal recirculation pump (not shown) to periodically recirculate subject material through dynamic route 20. Subject material having particulate matter, such as a slurry, experiences gravity separation over time. Separation of such particulate matter of the slurry is undesirable. For example, the particulate matter may settle in areas of piping, valves or other areas of a supply line which are difficult to reach and clean. Further, some particulate matter may be extremely difficult to resuspend once it has settled over a sufficient period of time. Accordingly, it is desirable to monitor turbidity (percent solids within a liquid) of the subject material to enable reduction or minimization of excessive settling.

Figure 2:
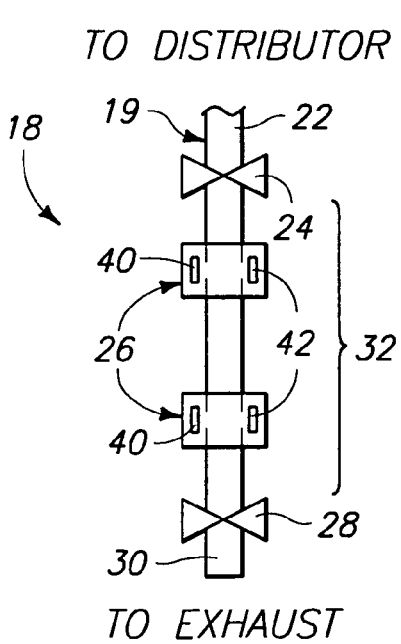
FIG. 2 is an illustrative representation of an exemplary arrangement for monitoring a static slurry.

Referring to FIG. 2, details of an exemplary static route 18 coupled with distributor 14 are illustrated. Static route 18 includes an elongated tube or pipe 19 for receiving subject material from distributor 14. In a preferred embodiment, pipe 19 comprises a transparent or translucent material, such as a transparent or translucent plastic. Static route 18 is coupled with distributor 14 at an intake end 22 of pipe 19. Piping hardware provided within the depicted static route 18 includes an intake valve 24, sensors 26 and an exhaust valve 28. Exhaust valve 28 is adjacent an exhaust end 30 of static route 18.

Valves 24, 28 can be selectively controlled to provide monitoring of the subject material of distributor 14 in a substantially static state. For example, with exhaust valve 28 in a closed state, intake valve 24 may be selectively opened to permit the entry of subject material within an intermediate container 32. Container 32 can be defined as the portion of static route 18 intermediate intake valve 24 and exhaust valve 28 in the described configuration. In typical operations, intake valve 24 is sealed or closed following entry of subject material into container 32. In the depicted arrangement, static route 18 is provided in a substantially vertical orientation. Static route 18 using valves 24, 28 and container 32 is configured to provide received subject material in a substantially static state (e.g., the subject material is not in a flowing state).

Plural sensors 26 are provided at predefined positions relative to container 32 as shown. Sensors 26 are configured to monitor the opaqueness or turbidity of subject material received within static route 18. In one configuration, plural sensors 26 are provided at different vertical positions to provide monitoring of the turbidity of the subject material within container 32 at corresponding different desired vertical positions of container 32. Such can be utilized to provide differential information between the sensors 26 to indicate small changes in slurry settling.

As described in further detail below, individual sensors include a source 40 and a receiver 42. In one configuration, source 40 is configured to emit electromagnetic energy towards container 32. Receiver 42 is configured and positioned to receive at least some of the electromagnetic energy. As described above, pipe 19 can comprise a transparent or translucent material permitting passage of electromagnetic energy. Sensors 26 can output signals indicative of the turbidity at the corresponding vertical positions of container 32 responsive to sensing operations.

It is desirable to provide plural sensors 26 in some configurations to monitor settling of particulate material (precipitation rates) over time within the subject material at plural vertical positions. Monitoring a substantially static subject material provides numerous benefits. Utilizing one or more sensors 26, the rate of separation can be monitored providing information regarding the condition of the subject material or slurry (e.g., testing and quantifying characteristics of a CMP slurry).

Properties of the subject material can be derived from the monitoring including, for example, how well particulate matter is suspended, adequate mixing, amount of or effectiveness of surfactant additives, the approximate size of the particulate matter, agglomeration of particulate matter, slurry age or lifetime, and likelihood of slurry causing defects. Such monitoring of settling rates can indicate when to change or drain a slurry being applied to semiconductor processor 12 to avoid degradation in processing performance, such as polishing performance within a chemical-mechanical polishing processor.

Subject material within container 32 may be drained via exhaust valve 28 following monitoring of the subject material. Exhaust end 30 of static route 18 can be coupled with a recovery system for direction back to distributor 14, or to a drain if the subject material will not be reused.

Figure 3:
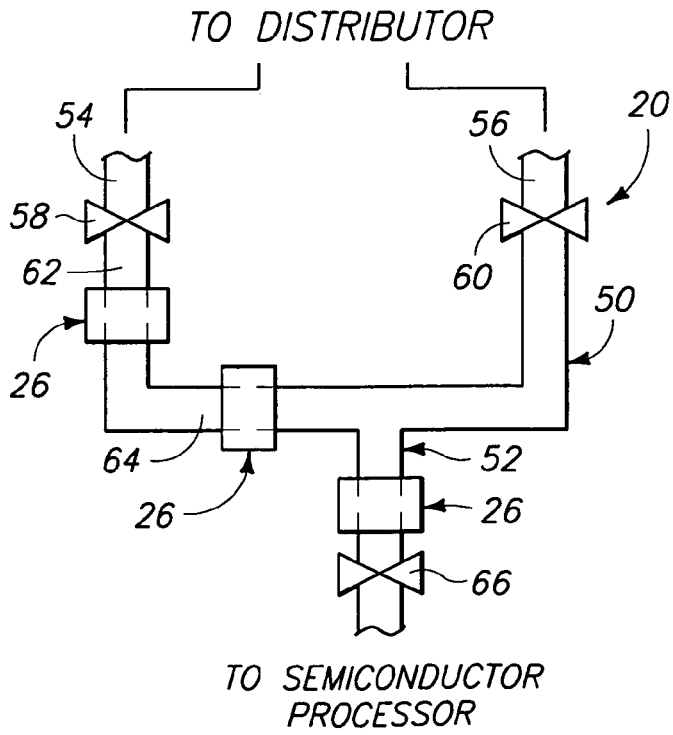
FIG. 3 is an illustrative representation of an exemplary arrangement for monitoring a dynamic slurry.

Referring to FIG. 3, details of dynamic route 20 are described. Dynamic route 20 comprises a recirculation pipe 50 coupled with a supply connection 52. Recirculation pipe 50 and supply connection 52 preferably comprise transparent or translucent tubing or piping, such as transparent or translucent plastic pipe.

Recirculation pipe 50 includes an intake end 54 and a discharge end 56. Subject material or slurry can be pumped into recirculation pipe 50 via intake end 54. An intake valve 58 and an exhaust or discharge valve 60 are coupled with recirculation pipe 50 for controlling the flow of subject material. Plural sensors 26 are provided within sections of recirculation pipe 50 as shown. One of sensors 26 is vertically arranged with respect to a vertical pipe section 62. Another of sensors 26 is horizontally oriented with respect to a horizontal pipe section 64. Sensors 26 are configured to monitor the turbidity of subject material or slurry within vertical pipe section 62 and horizontal pipe section 64.

Individual sensors 26 configured to monitor horizontal pipe sections (e.g., pipe section 64) may be arranged to monitor a lower portion of the horizontal pipe for gravity settling of particulate matter. As described below, an optical axis of sensor 26 can be aimed to intersect a lower portion of horizontally arranged tubing or piping to provide the preferred monitoring. Such can assist with detection of precipitation of particulate matter which can form into large undesirable particles leading to defects. Accordingly, once a turbidity limit has been reached, the tubing or piping may be flushed.

Supply connection 52 is in fluid communication with horizontal pipe section 64. In addition, supply connection 52 is in fluid communication with process chamber 16 of semiconductor processor 12 shown in FIG. 1. Supply connection 52 is configured to supply subject material such as slurry to process chamber 16. A sensor 26 is provided adjacent supply connection 52. Sensor 26 is configured to monitor the turbidity of subject material within supply connection 52. Additionally, a supply valve 66 controls the flow of subject material within supply connection 52.

Although only one supply connection 52 is illustrated, it is understood that additional supply connections can be provided to couple associated semiconductor processors (not shown) with recirculation pipe 50 and distributor 14. The depicted supply connection 52 is arranged in a vertical orientation. Supply connection 52 with associated sensor 26 may also be provided in a horizontal or other orientation in other configurations.

Figure 4:
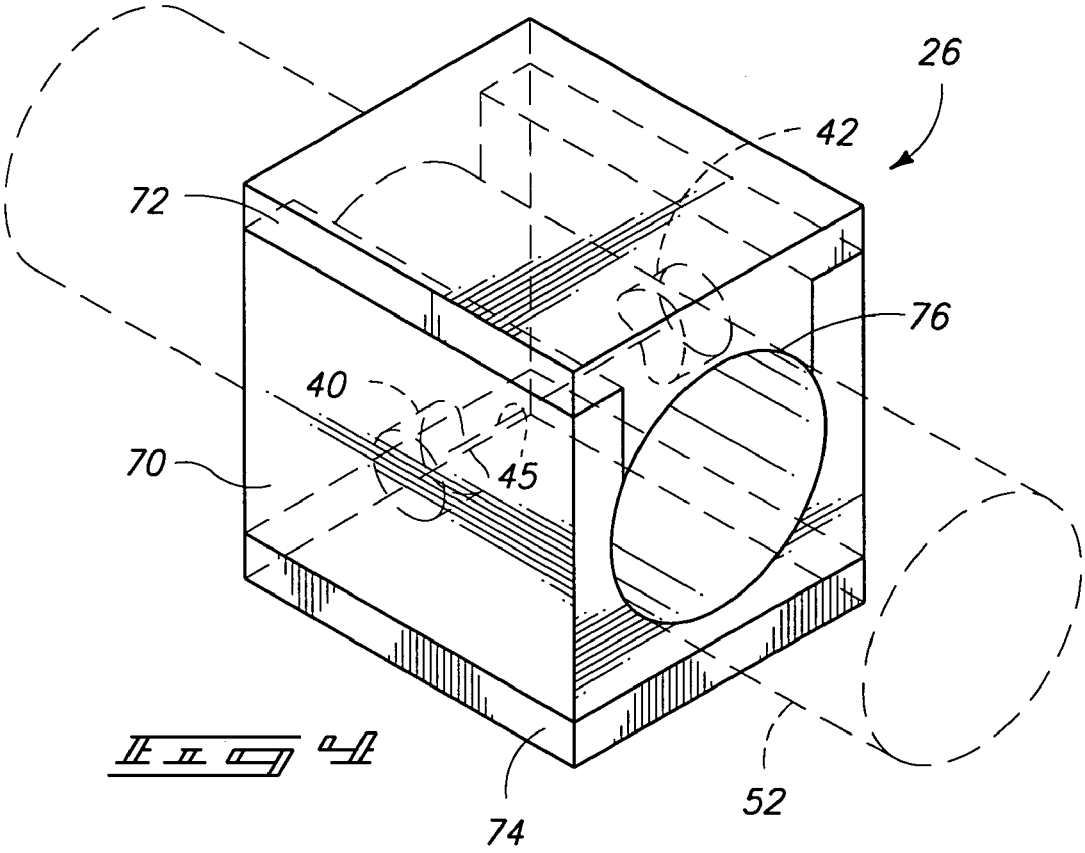
FIG. 4 is an isometric view of one configuration of a turbidity sensor.

Referring to FIG. 4, an exemplary configuration of sensor 26 is shown. The illustrated configuration of sensor 26 includes a housing 70, cover 72 and associated circuit board 74. The illustrated housing 70 is configured to couple with a conduit, such as supply connection 52. For example, housing 70 is arranged to receive supply connection 52 with a longitudinal orifice 76. Cover 72 is provided to substantially enclose supply connection 52. In a preferred arrangement, housing 70 and cover 72 are formed of a substantially opaque material.

Housing 70 is configured to provide source 40 and receiver 42 adjacent supply connection 52. More specifically, housing 70 is configured to align source 40 and receiver 42 with respect to supply connection 52 and any subject material such as slurry therein. In the depicted configuration, housing 70 aligns source 40 and receiver 42 to define an optical axis 45 which passes through supply connection 52.

The illustrated housing 70 is configured to allow attachment of sensor 26 to supply connection 52 or detachment of sensor 26 from supply connection 52 without disruption of the flow of subject material within supply connection 52. Housing 70 can be clipped onto supply connection 52 as illustrated or removed therefrom without disrupting the flow of subject material within supply connection 52 in the described embodiment.

Source 40 and receiver 42 may be coupled with circuit board 74 via internal connections (not shown). Further details regarding circuitry implemented within circuit board 74 are described below. The depicted sensor configuration provides sensor 26 capable of monitoring the turbidity of subject material within supply connection 52 without contacting and possibly contaminating the subject material or without disrupting the flow of subject material within supply connection 52.

More specifically, sensor 26 is substantially insulated from the subject material within supply connection 52 in the described arrangement. Accordingly, sensor 26 provides a non-intrusive device for monitoring the turbidity of subject material 80. Such is preferred in applications wherein contamination of subject material 80 is a concern. Utilization of sensor 26 does not impede or otherwise affect flow of the subject material.

In one configuration, source 40 comprises a light emitting diode (LED) configured to emit infrared electromagnetic energy. Source 40 is configured to emit electromagnetic energy of another wavelength in an alternative embodiment. Receiver 42 may be implemented as a photodiode in an exemplary embodiment. Receiver 42 is configured to receive electromagnetic energy emitted from source 40. Receiver 42 of sensor 26 is configured to generate a signal indicative of the turbidity of the subject material and output the signal to associated circuitry for processing or data logging.

Figure 5:
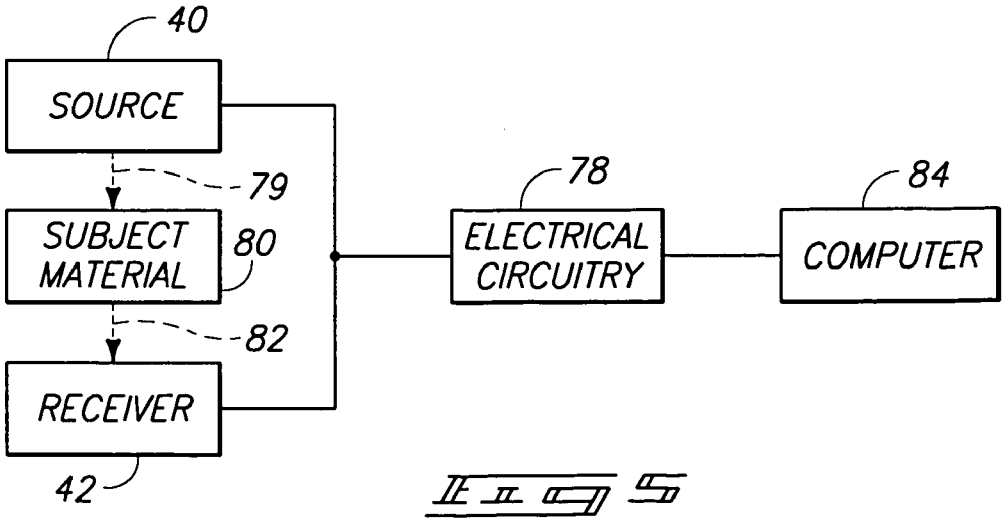
FIG. 5 is a cross-sectional view of another sensor configuration.

Referring to FIG. 5, source 40 and receiver 42 are coupled with electrical circuitry 78. In the illustrated embodiment, source 40 and receiver 42 are aimed towards one another. Source 40 is operable to emit electromagnetic energy 79 towards subject material 80. Particulate matter within subject material 80 operates to absorb some of the emitted electromagnetic energy 79. Accordingly, only a portion, indicated by reference 82, of the emitted electromagnetic energy 79 passes through subject material 80 and is received within receiver 42.

Electrical circuitry 78 is configured to control the emission of electromagnetic energy 79 from source 40 in the described configuration. Receiver 42 is configured to output a signal indicative of the received electromagnetic energy 82 corresponding to the intensity of the received electromagnetic energy. Electrical circuitry 78 receives the outputted signal and, in one embodiment, conditions the signal for application to an associated computer 84. In one embodiment, computer 84 is configured to compile a log of received information from receiver 42 of sensor 26.

Figure 6:
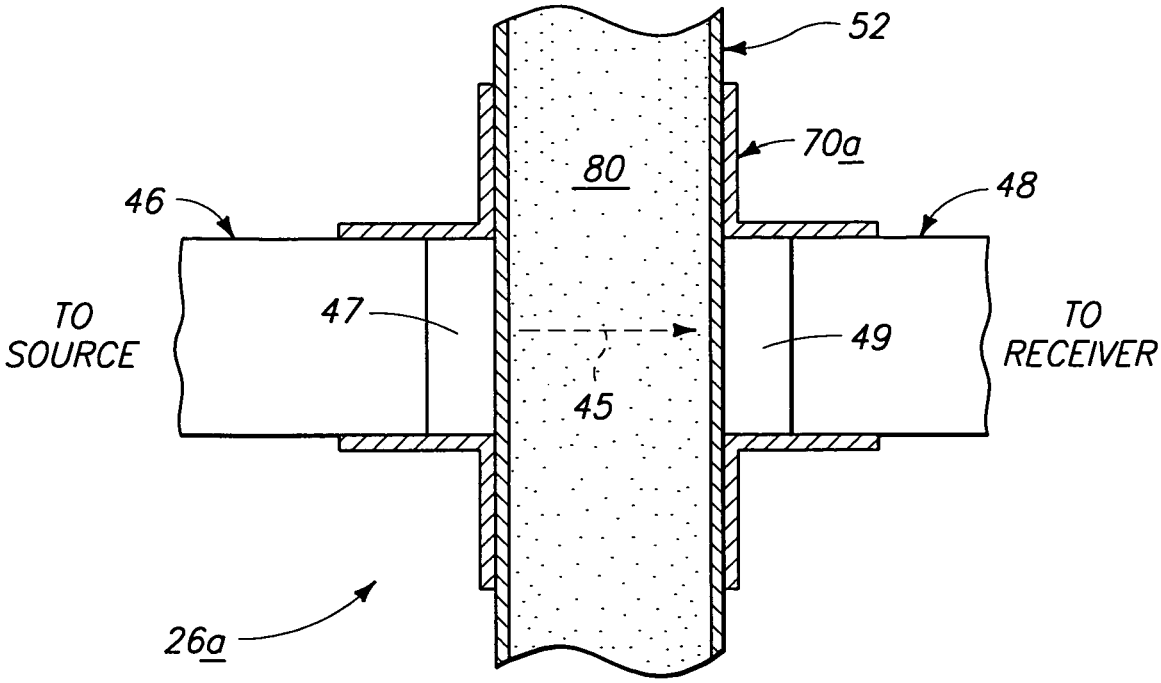
FIG. 6 is an illustrative representation of an exemplary arrangement of a source and receiver of a sensor.

Referring to FIG. 6, an alternative sensor arrangement indicated by reference 26*a* is shown. In the depicted embodiment, an alternative housing 70*a* is implemented as a cross fitting 44 utilized to align the source and receiver of sensor 26*a* with supply connection 52. Supply connection 52 is aligned along one axis of cross fitting 44.

In the depicted configuration, light-carrying cable or light pipe, such as fiberoptic cable, is utilized to couple a remotely located source and receiver with supply connection 52. A first fiberoptic cable 46 provides electromagnetic energy emitted from source 42 to supply connection 52. A lens 47 is provided flush against supply connection 52 and is configured to emit the electromagnetic light energy from cable 46 towards supply connection 52 along optical axis 45 perpendicular to the axis of supply connection 52. Electromagnetic energy which is not absorbed by subject material 80 is received within a lens 49 coupled with a second fiberoptic cable 48. Fiberoptic cable 48 transfers the received light energy to receiver 42. Sensor arrangement 26*a* can include appropriate seals, bushings, etc., although such is not shown in FIG. 6.

As previously mentioned, supply connection 52 is preferably transparent to pass as much electromagnetic light energy as possible. Supply connection 52 is translucent in an alternative arrangement. Lenses 47, 49 are preferably associated with supply connection 52 to provide maximum transfer of electromagnetic energy. In other embodiments, lenses 47, 49 are omitted. Further alternatively, the source and receiver of sensor 26 may be positioned within housing 70*a* in place of lenses 47, 49. Fiberoptic cables 46, 48 could be removed in such an embodiment.

Figure 7:
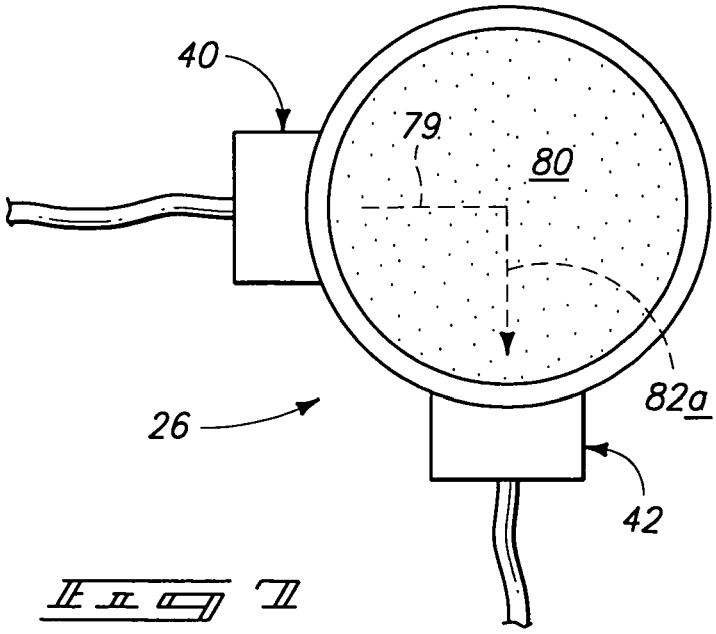
FIG. 7 is a functional block diagram illustrating components of an exemplary sensor and associated circuitry.

Referring to FIG. 7, another implementation of sensor 26 is shown. Source 40 and receiver 42 are arranged at a substantially 90° angle in the depicted configuration. Source 40 operates to emit electromagnetic energy 79 into supply connection 52 and subject material 80 within supply connection 52. As previously stated, subject material 80 can contain particulate matter which may operate to reflect light. Receiver 42 is positioned in the depicted arrangement to receive such reflected light 82*a*. Associated electrical circuitry coupled with source 40 and receiver 42 can be calibrated to provide accurate turbidity information responsive to the reception of reflected light 82*a*. Although source 40 and receiver 42 are illustrated at a 90° angle in the depicted arrangement, source 40 and receiver 42 may be arranged at any other angular relationship with respect to one another and supply connection 52 to provide emission of electromagnetic energy 79 and reception of reflected electromagnetic energy 82*a*.

Figure 8:
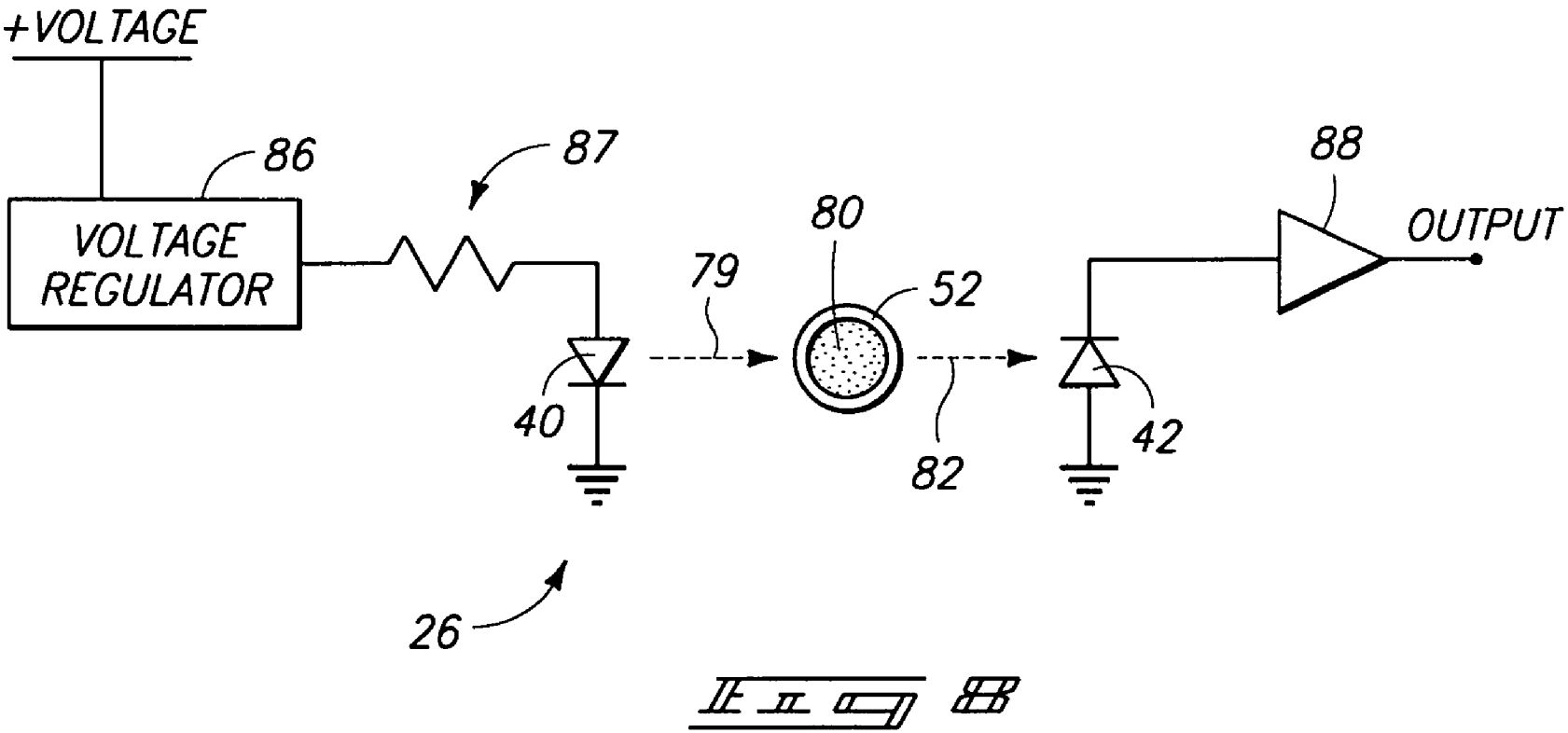
FIG. 8 is a schematic diagram of an exemplary sensor configuration.

Referring to FIG. 8, one arrangement of sensor 26 for providing turbidity information of subject material 80 is shown. Source 40 is implemented as a light emitting diode (LED) configured to emit infrared electromagnetic energy 79 towards supply connection 52 having subject material 80 in the depicted arrangement. A positive voltage bias may be applied to a voltage regulator 86 configured to output a constant supply voltage. For example, the positive voltage bias can be a 12 Volt DC voltage bias and voltage regulator 86 can be configured to provide a 5 Volt DC reference voltage to light emitting diode source 40.

Source 40 emits electromagnetic energy of a known intensity responsive to an applied current from dropping resistor 87. Receiver 42 comprises a photodiode in an exemplary embodiment configured to receive light electromagnetic energy 82 not absorbed within subject material 80. Photodiode receiver 42 is coupled with an amplifier 88 in the depicted configuration. Amplifier 88 is configured to provide an amplified output signal indicating the turbidity of subject material 80. Other configurations of source 40 and receiver 42 are possible.

Referring to FIG. 9, additional details of the arrangement shown in FIG. 8 are illustrated. Source 40 is implemented as a light emitting diode (LED). Receiver 42 comprises a photodiode. A potentiometer 90 is coupled with a pin 1 and a pin 8 of amplifier 88 and can be varied to provide adjustment of the gain of amplifier 88. An exemplary variable base resistance of potentiometer 90 is 100 Ωk.

Another potentiometer 92 is coupled with a pin 5 of amplifier 88 and is configured to provide calibration of sensor 26. Potentiometer 92 may be varied to provide an offset of the output reference of amplifier 88. An exemplary variable base resistance of potentiometer 92 is 500Ω.

A positive voltage reference bias is applied to a diode 94. An exemplary positive voltage is approximately 12-24 Volts DC. Voltage regulator 86 receives the input voltage and provides a reference voltage of 5 Volts DC in the described embodiment.

Figure 10:
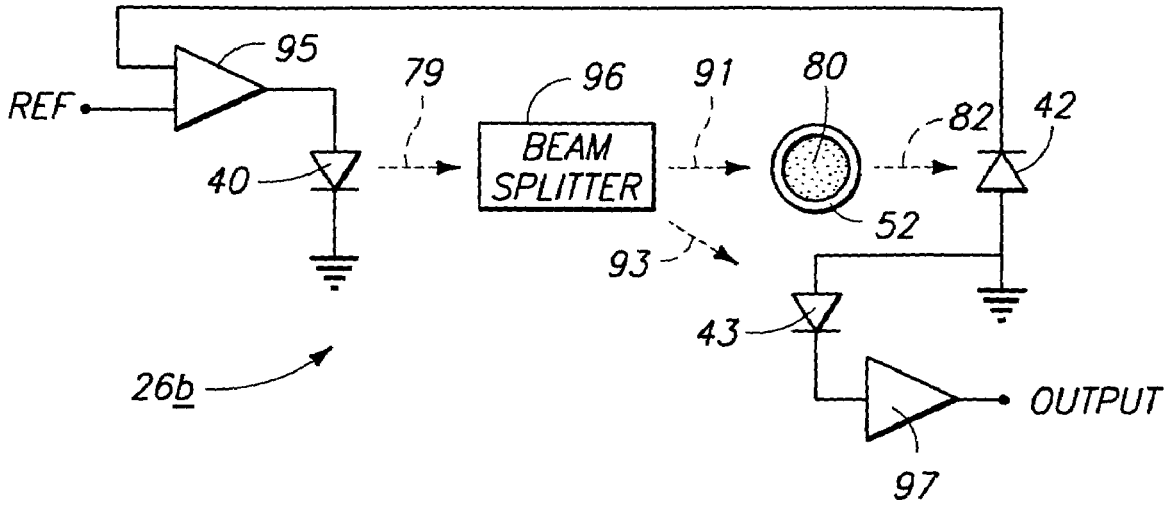
FIG. 10 is a schematic diagram of another exemplary sensor configuration.
Figure 11:
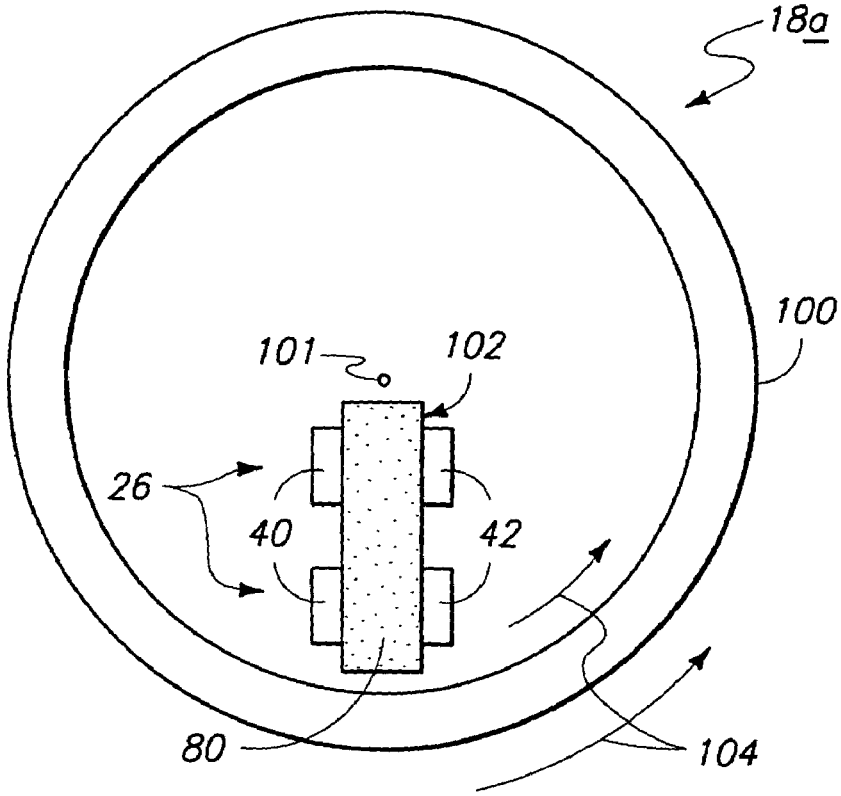

Referring to FIG. 10, an alternative sensor configuration is illustrated as reference 26*b*. The illustrated sensor configuration includes a driver 95 coupled with source 40. Additionally, a beam splitter 96 is provided intermediate source 40 and supply connection 52. Further, an additional receiver 43 and associated amplifier 97 are provided as illustrated.

A reference voltage is applied to driver 95 during operation. Source 40 is operable to emit electromagnetic energy 79 towards beam splitter 96. Beam splitter 96 directs received electromagnetic energy into a beam 91 towards supply connection 52 and a beam 93 towards receiver 43. Receiver 42 is positioned to receive non-absorbed electromagnetic energy 91 passing through supply connection 52 and subject material 80. Receiver 42 is configured to generate and output a feedback signal to driver 95. The feedback signal is indicative of the electromagnetic energy 91 received within receiver 42.

The depicted sensor 26*b* is configured to provide a substantially constant amount of light electromagnetic energy to receiver 42. Driver 95 is configured to control the amount or intensity of emitted electromagnetic energy from source 40. More specifically, driver 95 is configured in the described embodiment to increase or decrease the amount of electromagnetic energy 79 emitted from source 40 responsive to the feedback signal from receiver 42.

Receiver 43 is positioned to receive the emitted electromagnetic energy directed from beam splitter 96 along beam 93. Receiver 43 receives electromagnetic energy not passing through subject material 80 in the depicted embodiment. The output of receiver 43 is applied to amplifier 97 which provides a signal indicative of the turbidity of subject material 80 within supply connection 52 responsive to the intensity of electromagnetic energy of beam 93.

Figure 11:
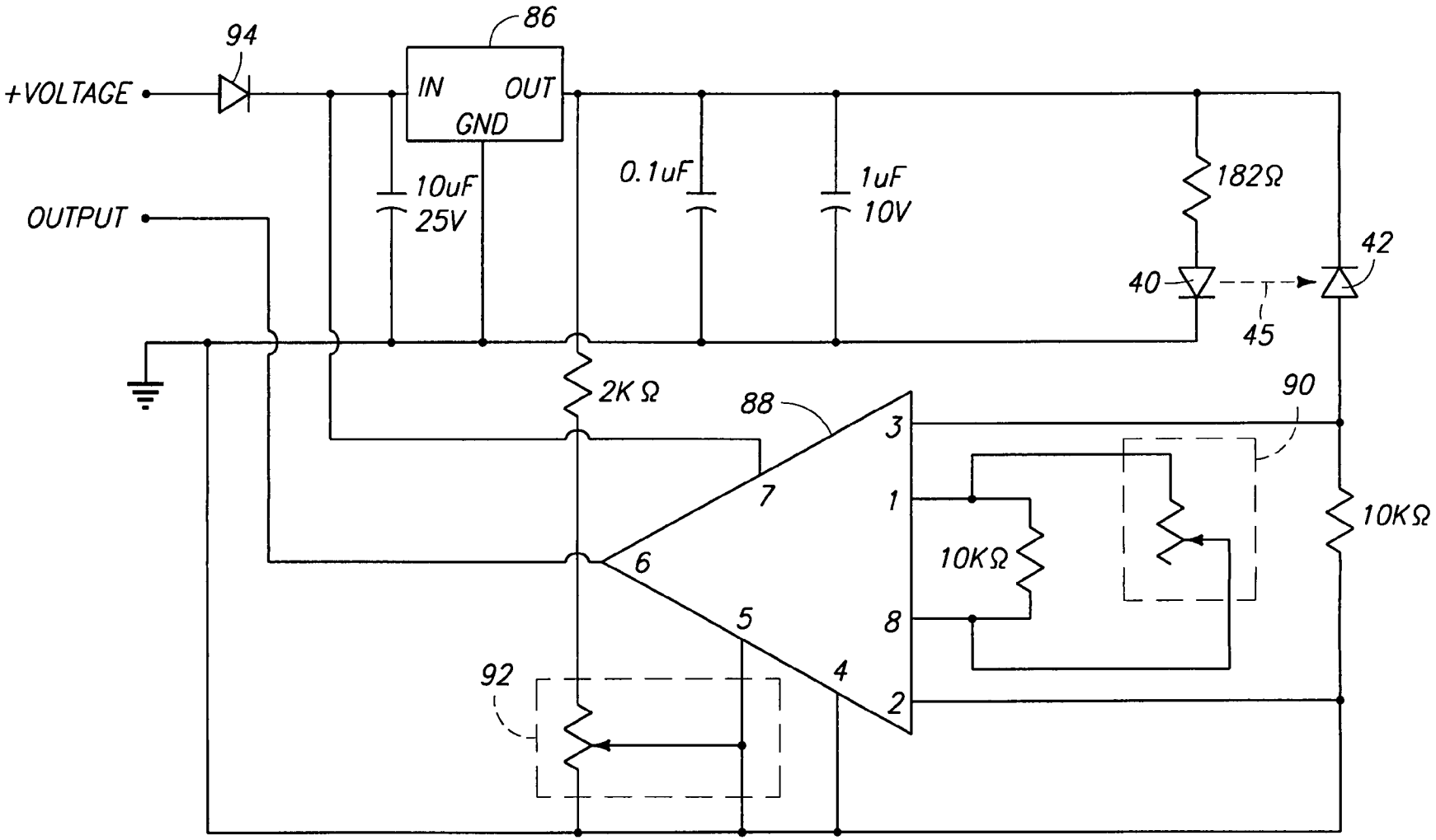
FIG. 11 is an illustrative representation of a sensor implemented in a centrifuge application.

Referring to FIG. 11, an exemplary alternative configuration for analyzing slurry in a substantially static state is shown. The illustrated static route 18*a* comprises a centrifuge 100. The depicted centrifuge 100 includes a container 102 configured to receive subject material 80. Plural sensors 26 are provided at predefined positions along container 102 to monitor the turbidity of subject material 80 at different radial positions. Centrifuge 100 including container 102 is configured to rapidly rotate in the direction indicated by arrows 104 about axis 101 to assist with precipitation of particulate matter within subject material 80. Such provides increased setting rates of the particulate matter. Sensors 26 can individually provide turbidity information of subject material 80 at the predefined positions of sensors 26 relative to container 102. Such information can indicate the state or condition of the slurry as previously discussed. Centrifuge 100 can be configured to receive samples of slurry or other subject material during operation of semiconductor workpiece system 10. Information from sensors 26 can be accessed via rotary couplings or wireless configurations during rotation of container 102 in exemplary embodiments.

From the foregoing, it is apparent the present invention provides a sensor which can be utilized to monitor turbidity of a nearly opaque fluid. Further, the disclosed sensor configurations have a wide dynamic range, are nonintrusive and have no wetted parts. In addition, the sensors of the present invention are cost effective when compared with other devices, such as densitometers.

Figure 12:
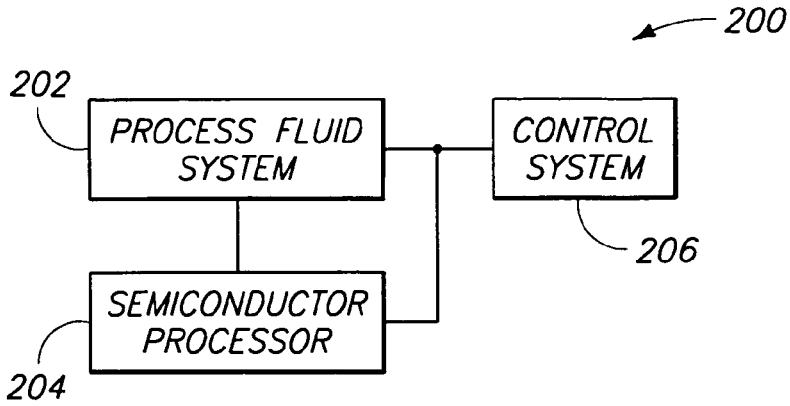
FIG. 12 is a functional block diagram of an exemplary semiconductor processor system.

Referring to FIG. 12, components of an exemplary semiconductor processor system 200 are shown. The depicted semiconductor processor system 200 includes a process fluid system 202, a semiconductor processor 204, and a control system 206 coupled with process fluid system 202 and semiconductor processor 204.

Process fluid system 202 is configured in the described embodiment to apply process fluid to semiconductor processor 204. An exemplary semiconductor processor 204 comprises a chemical-mechanical polisher, such as a Model 6DSP available from Strasbaugh, Inc. An exemplary process fluid includes a slurry for use in chemical-mechanical polishing of semiconductor workpieces. Exemplary semiconductor workpieces include semiconductor wafers, such as silicon wafers.

Semiconductor processor 204 is configured to receive semiconductor workpieces and provide processing of the semiconductor workpieces. Control system 206 is configured to monitor operations of process fluid system 202 and semiconductor processor 204 and control operations of semiconductor processor system 200 including system 202 and processor 204 responsive to such monitoring.

Figure 13:
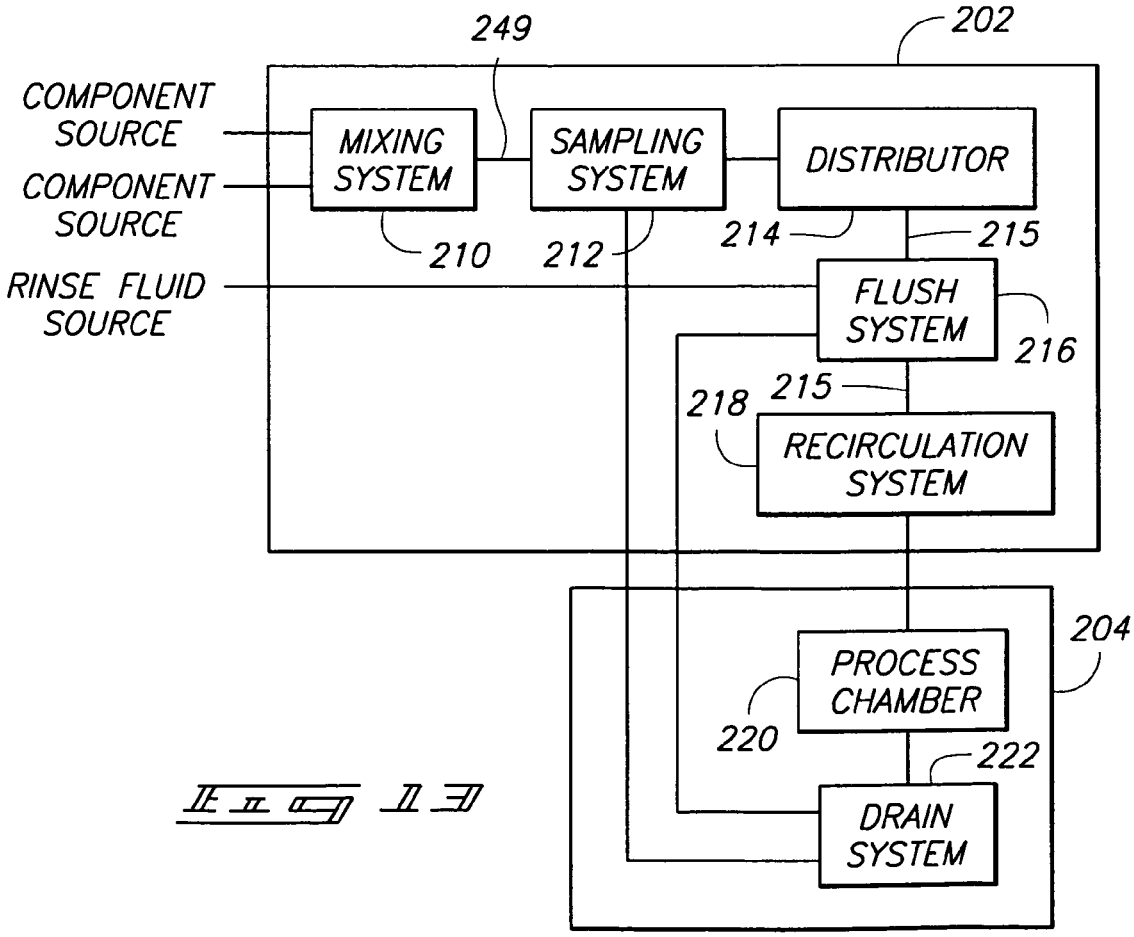
FIG. 13 is a functional block diagram of exemplary components of the semiconductor processor system.
Figure 11A:
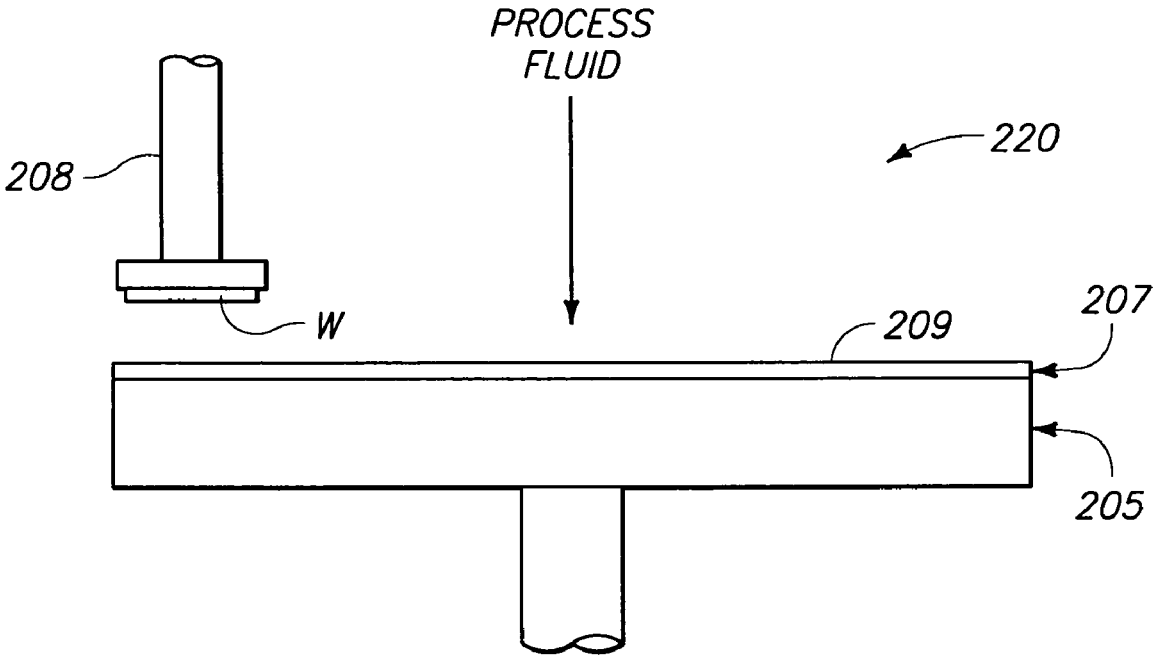
Figure 11:
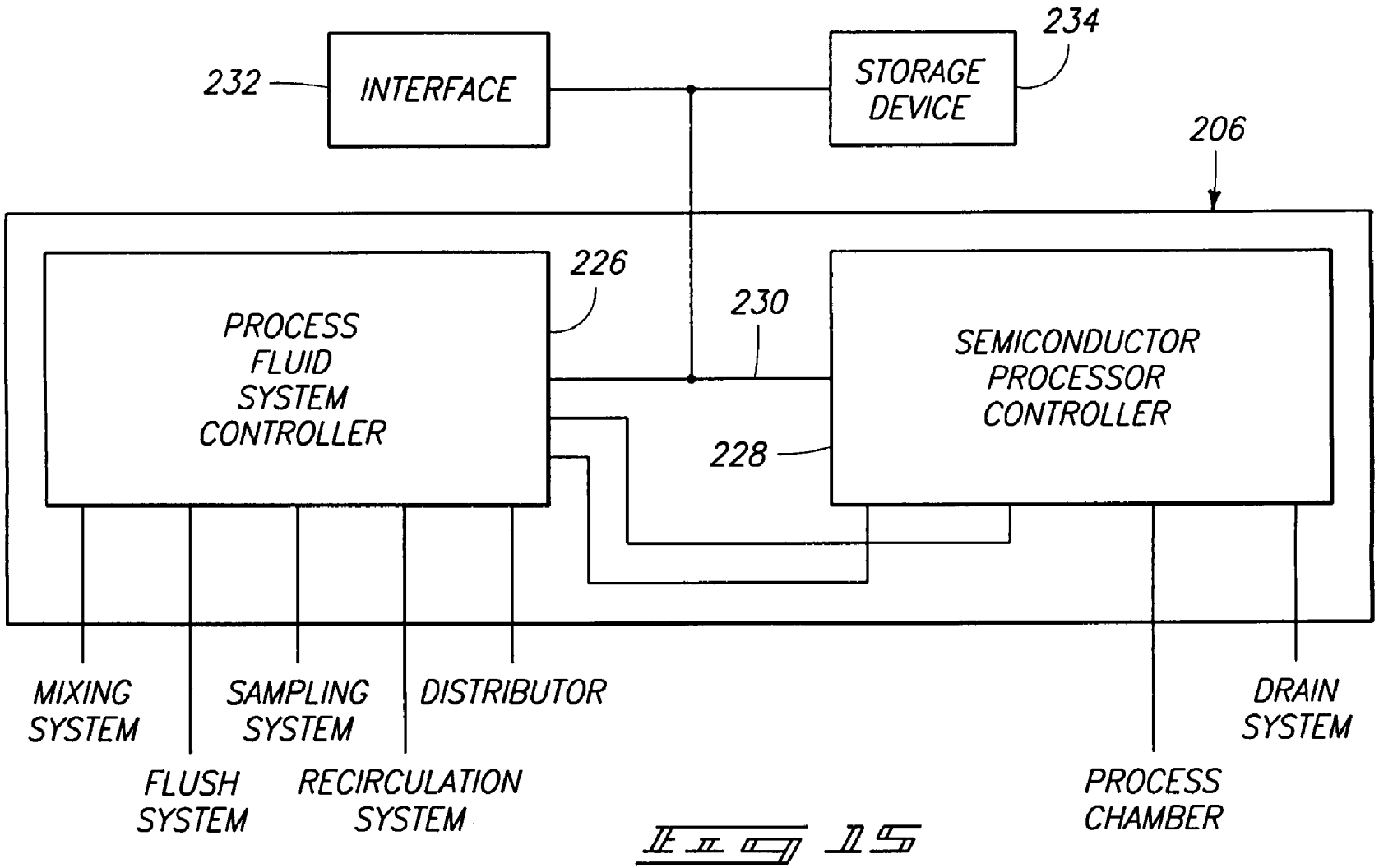
Figure 11:
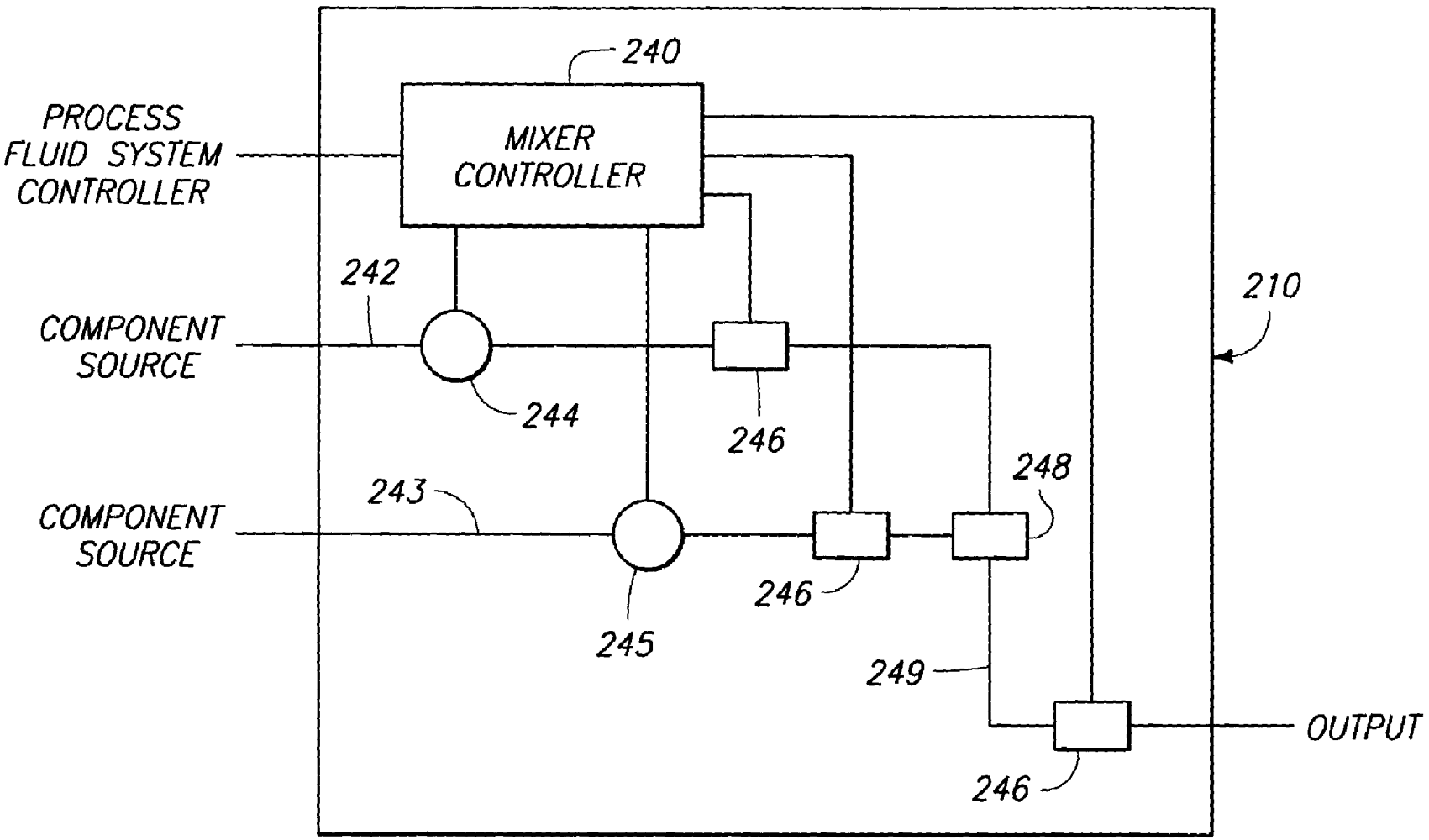
Figure 11:
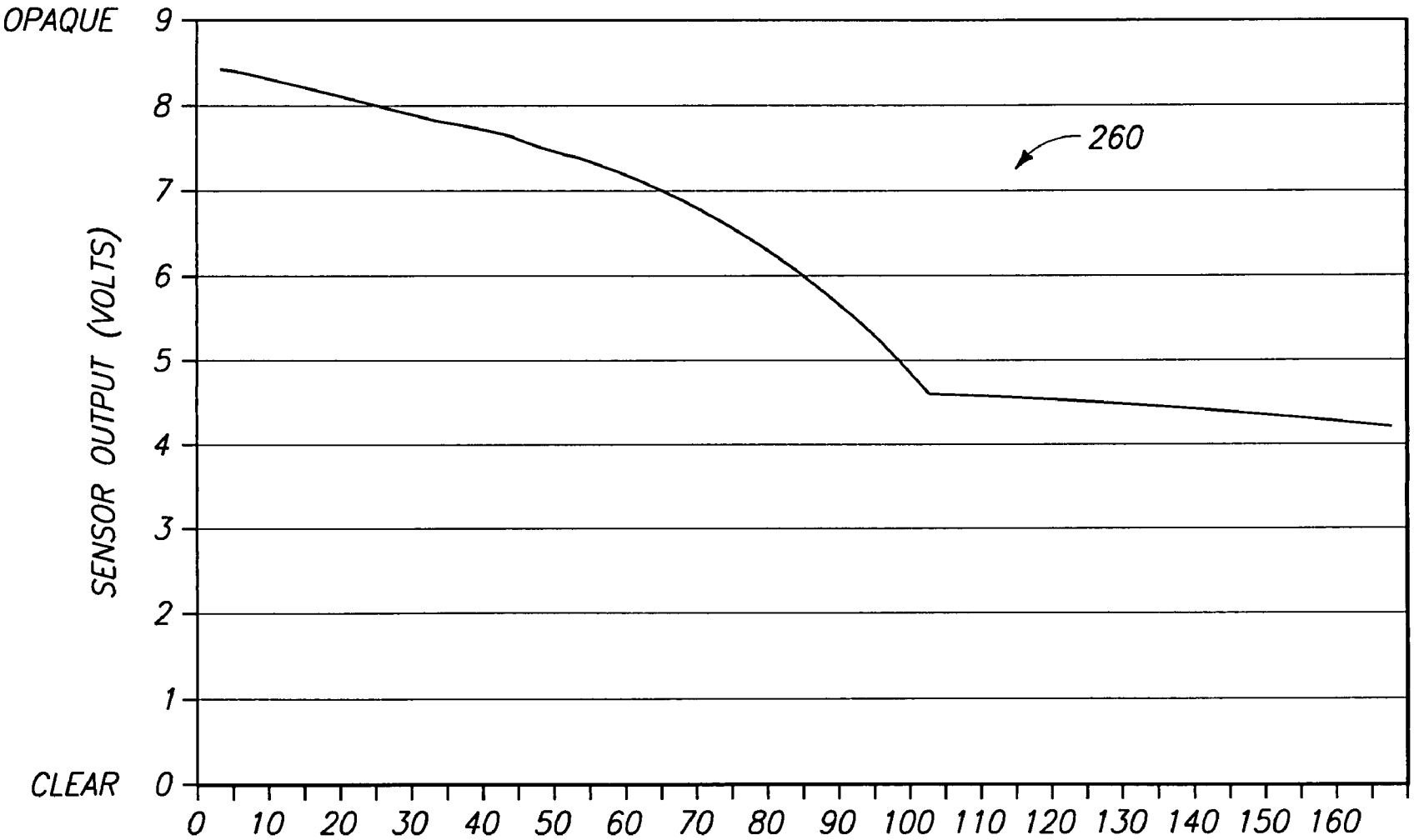
Figure 11:
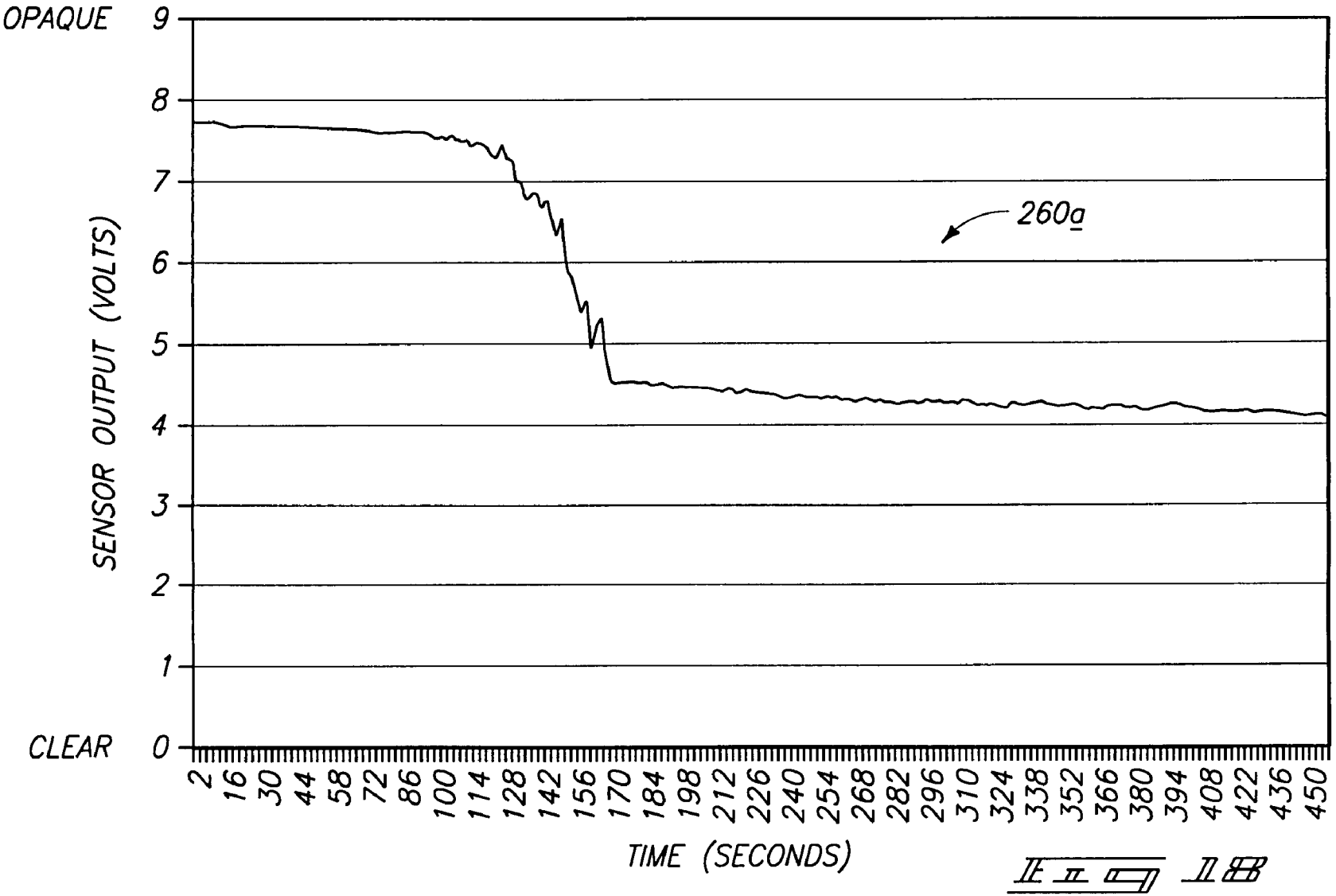

Referring to FIG. 13, further details of process fluid system 202 and semiconductor processor 204 are illustrated. Process fluid system 202 includes a mixing system 210, a sampling system 212, a distributor 214, a flush system 216 and a recirculation system 218. The depicted semiconductor processor 204 includes a process chamber 220 and a drain system 222.

Process fluid system 202 is configured to provide process fluid, such as a slurry, to process chamber 220. Mixing system 210 of process fluid system 202 is coupled with plural component sources external of semiconductor processor system 200 in the described embodiment. Exemplary component sources individually include one of a concentrated solids component and a clear fluid component.

Mixing system 210 is configured to receive and provide mixing of such components to form a desired process fluid for use within semiconductor processor 204. Sampling system 212 is configured to selectively draw a sample of process fluid from mixing system 210. Sampling system 212 is configured to monitor a drawn sample as described further below. Sampling system 212 provides the drawn sample in a substantially static state to provide such monitoring in the described embodiment.

Monitoring and analysis of the drawn sample of process fluid provides an indication of whether the process fluid is within proper specification before application of such process fluid to semiconductor processor 204. For example, the turbidity of the sample is analyzed in one embodiment to verify that the process fluid is within proper specification as described further below. Adverse processing of semiconductor workpieces can occur if the process fluid is out of the desired specification.

Distributor 214 is coupled with sampling system 212 and flush system 216. Although only shown coupled with one semiconductor processor 204 in the depicted configuration, distributor 214 is configured to supply process fluid to other semiconductor processors (not shown) in addition to the depicted semiconductor processor 204.

Process fluid system 202 includes flush system 216 and recirculation system 218 in the depicted embodiment. The depicted configuration of process fluid system 202 is exemplary. Alternative configurations of process fluid system 202 include only one or neither of flush system 216 and recirculation system 218.

A connection 215 is provided intermediate distributor 214 and process chamber 220 in the depicted embodiment. Connection 215 is coupled to receive process fluid from distributor 214. Flush system 216 and recirculation system 218 individually include a portion of connection 215 to provide process fluid coupling intermediate distributor 214 and process chamber 200.

Flush system 216 is configured to selectively prime and/or rinse connection 215 responsive to control from control system 206 of FIG. 12. Flush system 216 is configured to flush connection 215 with a flush fluid. As described below, flush system 216 is configured to utilize a flush fluid comprising one of a process fluid and a rinse fluid.

As shown, flush system 216 is coupled with a rinse fluid source, such as a de-ionized water source. In the described embodiment, flush system 216 is operable to prime connection 215 with flush fluid comprising the process fluid responsive to a start-up operation of semiconductor processor 204, and to rinse connection 215 with flush fluid comprising the rinse fluid responsive to a halt operation.

One exemplary process chamber 220 comprises a chemical-mechanical polisher process chamber in the described embodiment. Details of process chamber 220 are illustrated, for example, in Stephen A. Campbell, *The Science and Engineering of Microelectronic Fabrication*, pp. 253-257 (1996), incorporated herein by reference. Other configurations of process chamber 220 are possible.

Referring to FIG. 14, an exemplary process chamber 220 is shown. Process chamber 220 includes a table 205 having a polishing pad 207 thereover in the described embodiment. As shown, polishing pad 207 includes a polishing surface 209 configured to polish semiconductor workpiece W. In other arrangements, polishing surface 209 is provided in a web (roll to roll) or other implementation.

A wafer carrier 208 positions one or more semiconductor workpiece W opposite polishing pad 207. A slurry is deposited upon polishing pad 207 as shown. The semiconductor workpiece W is brought into contact with polishing pad 207 to implement processing of semiconductor workpiece W. Either one or both of wafer carrier 208 and table 205 are rotated during processing.

Referring to FIG. 15, an exemplary configuration of control system 206 is shown. The depicted control system 206 includes a process fluid system controller 226 and a semiconductor processor controller 228. A bus 230 couples process fluid system controller 226 and semiconductor processor controller 228.

Process fluid system controller 226 and semiconductor processor controller 228 are implemented as individual microprocessors, industrial PLCs or personal computers (PC)

in an exemplary configuration. In an alternative arrangement the control operations of semiconductor processor system 200 are implemented within a single controller. Additional distributed controllers are provided in yet another embodiment to control operations of semiconductor processor system 200.

As illustrated, an interface 232 and memory 234 are coupled with bus 230 and respective controllers 226, 228. Interface 232 includes a display, such as a monitor, and an input, such as a keyboard, respectively configured to display operational status of semiconductor processor 204 and to receive commands from an operator. Interface 232 additionally includes a connection to couple with a remote network (not shown), such as a plant fabrication monitoring and control system. Interface 232 provides bi-directional communications with such a remote network.

Storage device 234 includes at least one of a random access memory device, a read only memory device, and a hard disk storage device in the described embodiment. Storage device 234 is utilized in the described embodiment to store historical data corresponding to operations of semiconductor processor 204. Such historical data is retrievable and accessible from storage device 234 using interface 232 and the remote network in the described embodiment.

For example, process fluid system controller 226 and semiconductor processor controller 228 provide monitored data within storage device 234 to provide a historical log of operations of semiconductor processor system 200. As described herein, sensor configurations are provided to monitor the turbidity of a process fluid, such as a slurry, utilized within semiconductor processor 204. If problems are experienced during the operation of semiconductor process system 200 (e.g., a high number of processing defects are observed during a given batch), the historical data provided within storage device 234 may be utilized to provide information regarding detailed operations of semiconductor processor system 200 and the associated process fluid being utilized within semiconductor processor system 200. Such may indicate whether the process fluid was defective or out of specification during processing operations.

Process fluid system controller 226 is coupled with mixing system 210, sampling system 212, distributor 214, flush system 216 and recirculation system 218. Semiconductor processor controller 228 is coupled with process chamber 220 and drain system 222.

Process fluid system controller 226 and semiconductor processor controller 228 are individually coupled with respective sensors and process system elements within the respective identified systems. Process fluid controller 226 and semiconductor processor controller 228 are configured in the described arrangement to monitor operations of the associated systems of semiconductor processor system 200 using outputs from sensors as described below. The disclosed process fluid system controller 226 and semiconductor processor controller 228 additionally control process system elements (e.g., pumps, valves, etc.) of the associated systems as described further below.

Controllers 226, 228 communicate with one another using bus 230. Process fluid system controller 226 is configured to apply appropriate data and/or commands to semiconductor processor controller 228 and vice versa. For example, controller 226 applies "immediate halt" and "halt after current wafer" commands to controller 228 when appropriate. Controller 228 is configured to indicate the current mode of operation of semiconductor processor 204 to controller 226. For example, controller 228 selectively issues instructions requesting slurry utilized for processing or instructions requesting a halt of the slurry supply.

Referring to FIG. 16, details of one exemplary configuration of mixing system 210 are illustrated. The depicted mixing system 210 includes a dedicated mixer controller 240. Mixer controller 240 is implemented as a microprocessor in the described embodiment. Mixer controller 240 communicates with process fluid system controller 226. Control information and mixing data is exchanged intermediate controllers 226, 240.

Mixer controller 240 is configured to control the mixing of components to form a process fluid for utilization within semiconductor processor system 200. Mixing system 210 includes plural supply lines or connections 242, 243 coupled with respective component sources. For example, supply line 242 is coupled with a concentrated solids component source and supply line 243 is coupled with a clear fluid component source. Such components are mixed in the described embodiment to form a chemical-mechanical polishing slurry. Other process fluids are formed in other embodiments.

Mixing system 210 includes metering devices 244, 245, such as pumps, coupled with respective supply lines 242, 243. Plural sensors 246 are also coupled with respective supply lines 242, 243. Sensors 246 are configured to monitor turbidity in the described arrangement. Sensors 246 are implemented using the sensor configurations 26 described above with reference to FIG. 4 in one configuration. Sensors 246 are individually configured to monitor turbidity of a material passing through an associated connection. Other configurations of sensors 246 are possible. For example, sensors 246 comprising acoustic sensors, resistive sensors, densitometers, etc. are implemented in alternative arrangements.

Supply lines 242, 243 form inputs to mixer 248. Mixer 248 is operable to provide mixing of components supplied via lines 242, 243 to provide a homogeneous process fluid in the described embodiment of the invention. During typical process operations, a process fluid, such as a slurry, is provided to process chamber 220. During chemical-mechanical polishing operations, the slurry contains particulate matter utilized to polish a surface of a semiconductor workpiece. It is desired to provide the slurry within a substantially homogeneous state before application to process chamber 220 and the polishing of associated semiconductor workpieces.

Output connection 249 couples mixer 248 with an output of mixing system 210. Sensor 246 is illustrated coupled with output connection 249. Output connection 249 provides a connection configured to supply the process fluid to sampling system 212 and distributor 214.

Sensors 246 are individually coupled with mixer controller 240. Sensors 246 are configured to output a signal indicative of the respective components or materials flowing through respective connections 242, 243, 249. The signals from sensors 246 are applied to mixer controller 240. Mixer controller 240 is considered part of control system 206 and is configured to control the mixing of the components responsive to the received signals.

The signals from sensors 246 provide feedback input to mixer controller 240 which in turn controls metering devices 244, 245 and the corresponding flow rates of respective components. For example, sensors 246 are configured in the described embodiment to provide turbidity information to mixer controller 240 regarding the fluids or materials within respective connections 242, 243, 249.

If the signal outputted from sensor 246 indicates an inappropriate range of turbidity for the process fluid flowing through output connection 249, mixer controller 240 controls the flow rates of the respective components using metering devices 244, 245. For example, the flow rate of metering device 244 is increased to increase the flow of concentrated solids if the process fluid within connection 249 should have increased turbidity. If the turbidity of the process fluid within connection 249 is too high as measured by sensor 246, mixer controller 240 controls metering device 245 to increase the flow rate of the clear fluid component to mixer 248.

Sensors 246 provide additional information regarding the condition of respective components within supply lines 242, 243. Turbidity information of respective process fluid components are detected using sensors 246 which provide feedback information to mixer controller 240. Thereafter, mixer controller 240 utilizes information from sensors 246 coupled with supply lines 242, 243 to adjust metering devices 244, 245 to maintain the process fluid within connection 249 within the desired turbidity range.

Referring to FIG. 17-FIG. 20, sampling operations of semiconductor processor system 200 are described. Sampling system 212 of FIG. 13 is coupled to receive the process fluid within output connection 249 of mixing system 210. Sampling system 212 draws a sample to monitor the condition of the process fluid.

Sampling system 212 is implemented using static route 18 described above with reference to FIG. 2 or static route 18*a* illustrated in FIG. 11 in exemplary configurations. For example, intake end 22 of static route 18 is coupled with connection 249 to receive process fluid. Other arrangements of sampling system 212 are utilized in other embodiments. One of such static route devices 18, 18*a* is coupled in the described embodiment to connection 249 containing the process fluid to be delivered to semiconductor processor 204. As described above, static route devices 18, 18*a* are configured to provide a sample of the process fluid in a substantially static state.

Static route devices 18, 18*a* include sensors 26 configured to monitor the turbidity of the process fluid. Such can be implemented using plural sensors 26 to provide differential turbidity measurements of the process fluid at different physical positions, or a single sensor 26 to provide a turbidity measurement at one position of the static route 18, 18*a*. Other monitoring operations include obtaining differential turbidity information of process fluid with respect to time (e.g., obtaining turbidity measurements at an initial moment in time and a subsequent moment in time). Such can be implemented with static or dynamic samples of process fluid. Sensor configurations other than sensors 26 are utilized in other configurations to monitor the samples of process fluids.

Exemplary process fluid fingerprints or signatures 260, 260*a* are respectively illustrated in FIG. 17 and FIG. 18. The graphical representations of FIG. 17-FIG. 18 display turbidity information of process fluid samples versus time. Turbidity is measured using the output voltage of sensors 26 of static routes 18, 18*a* in the described arrangement.

Process fluids such as slurries typically have an associated signature corresponding to precipitation rates of particulate matter within the process fluid. For example, the process fluid yielding the signature 260 in FIG. 17 contains no surfactant. The process fluid yielding the signature 260*a* illustrated in FIG. 18 includes a surfactant additive and precipitates at an increased rate compared with the process fluid graphed in FIG. 17.

As shown, the two process fluids provide different signatures 260, 260*a* corresponding to different precipitation rates. Depending upon the processing implemented within semiconductor processor 204, variances of the process fluid from a desired signature may produce undesirable processing results. For example, inappropriate pH ranges, the freezing of process slurry, as well as other conditions may adversely impact the process fluid resulting in undesirable processing performance. Utilizing sampling system 212 and sensors therein, control system 206 can compare a sample of process fluid within connection 249 with a desired signature to determine at least one characteristic of the process fluid.

Figure 19:
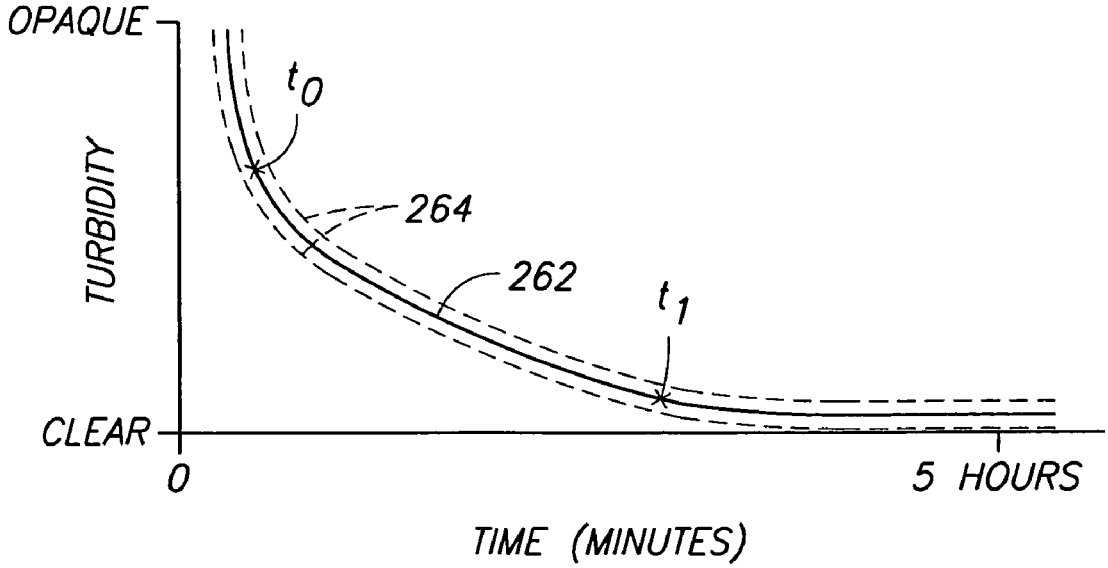
FIG. 19 is a graphical representation of a precipitation signature of an exemplary process fluid.

Referring to FIG. 19, an ideal or control process fluid signature 262 is illustrated. Such is provided for a given processing application and for comparison with the signatures of actual process 7 fluids within connection 249. Process fluid signature 262 is empirically derived or determined through test processing operations of semiconductor workpieces in exemplary embodiments to determine an ideal process fluid.

Following the determination of the ideal process fluid signature 262, process fluid signature limits 264 are developed to provide an acceptable range of fluctuation of the associated process fluid tested during processing operations with respect to the ideal process fluid signature 262. Acceptable deviation of the actual process fluid from the ideal process fluid signature is determined to set limits 264. Such limits 264 are chosen such that processing of semiconductor workpieces is not adversely impacted by utilization of process fluids within the range defined by limits 264.

During processing operations, control system 204 controls the appropriate sampling device of the sampling system 212 to receive a sample of process fluid. The sample is preferably provided in a substantially static state yielding an exemplary signature. The signature of the process fluid being tested is compared with the ideal signature 262 and process fluid signature limits 264. Control system 204 is configured to develop the signatures using data acquisition of information outputted from sensors within sampling system 212.

If the observed signature of the sample being tested falls within process fluid signature limits 264, the process fluid is acceptable and is applied to semiconductor processor 204 for processing. If it is determined that the signature of the sample of process fluid is outside of process fluid signature limits 264, control system 204 is configured to selectively prevent the entry of the process fluid into process chamber 220 of semiconductor processor 204. For example, process fluid may be flushed prior to application to distributor 214 using drain system 222. Thereafter, a new batch of process fluid may be mixed and tested using sampling system 212: to assure application of acceptable process fluid to process chamber 220.

Control system 204 implements a comparison of the actual sample of process fluid versus the ideal process fluid signature 262 and associated limits 264 to monitor the condition of the process fluid. Typical signatures of process fluids include three tiers indicating different precipitation rates over time. Such tiers may be utilized for comparison. A first tier of the signatures is from time 0 to the moment in time to shown in FIG. 19. The second tier of the signatures is intermediate the moments in time $t_0$-$t_1$. A third tier of the signatures is shown after the moment in time $t_1$.

During an exemplary comparison procedure, slopes of the signatures are measured between two points of one of the tiers and are compared with process fluid signature limits 264. Such comparison operations by process fluid system controller 226 detect the state of the process fluid being analyzed. For example, the analysis can detect large particulate precipitation, the amount or effectiveness of surfactant or suspension additives, agglomeration formed from freezing or excessive shearing. Such conditions or qualities of the process fluid affect the polishing performance of semiconductor processor 204. Other methods of analyzing a process fluid are utilized in other embodiments.

Responsive to the comparison, process fluid system controller 226 instructs semiconductor processor controller 228, if appropriate, to cease operation of semiconductor processor 204 until process fluid is brought within specification. Subsequent batches of process fluids are sampled using sampling system 212. Alternatively, processing within semiconductor processor 204 proceeds if the process fluid is within specification.

Figure 20:
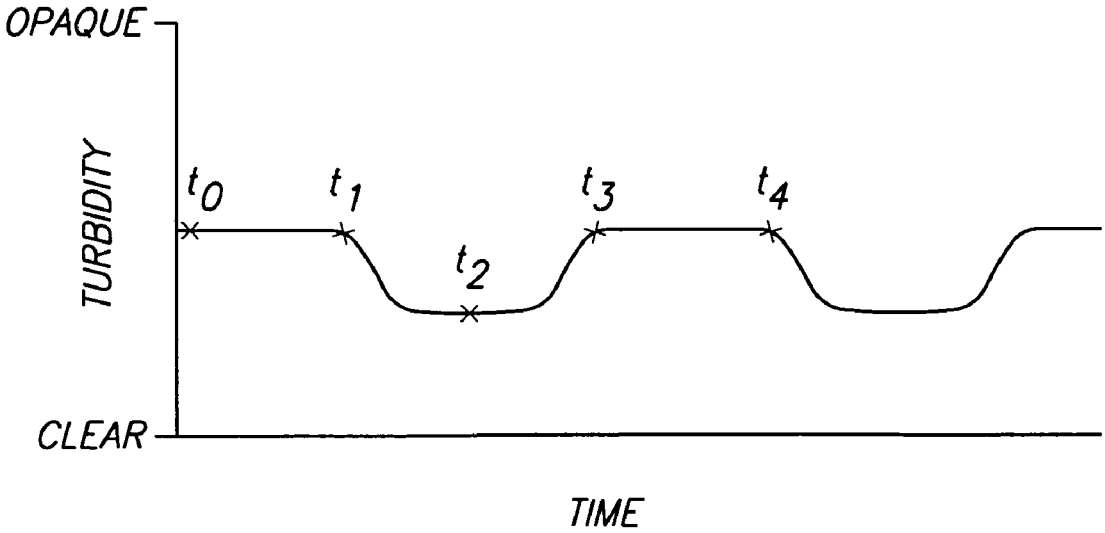
FIG. 20 is a graphical representation of turbidity of a process fluid during operations of the semiconductor processor system.

Referring to FIG. 20, an exemplary representation of the turbidity of process fluid entering semiconductor processor 204 during different modes of operation of semiconductor processor 240 is illustrated. In one embodiment of the invention, process fluid system controller 226 monitors the mode of operation of semiconductor processor 204 and determines the appropriate time for implementing process fluid functions within process fluid system 202.

For example, for times intermediate $t_0$ and $t_1$, semiconductor process 204 implements a polishing cycle. Accordingly, process fluid system 202 delivers process fluid using connection 249 and provides a homogeneous process fluid of substantially constant turbidity as indicated in the graphical representation.

At time $t_1$, the polishing cycle is finished and semiconductor processor 204 enters an idle state. Accordingly, process fluid system 202 is idle after time $t_1$ until time $t_2$. At time $t_2$, a start polish command is issued. The turbidity of the process fluid is lower at time $t_2$ due to settling of particulate matter within the process fluid during the idle state.

Following the initiation of a polishing cycle, the turbidity begins to increase as process fluid, flows within connection 249 and returns again at time $t_3$ to a substantially homogeneous mixture. At time $t_4$, the second polishing cycle ceases and once again the turbidity of the process fluid falls as particulate matter settles within the process fluid. As shown, the turbidity of the process fluid fluctuates depending upon the operation of semiconductor processor 204.

The monitoring of process fluid is conducted according to the mode of operation of semiconductor processor 204 in one embodiment. For some monitoring operations, it is desired to observe or obtain a signature of the process fluid when the process fluid is in a homogeneous state. Accordingly, samples using sampling system 212 are drawn at a specified period of time when the process fluid is in a homogeneous state.

For example, sampling operations may be implemented intermediate times $t_0$ and $t_1$, and times $t_3$ and $t_4$ to observe a homogeneous process fluid. Process fluid system controller 226 monitors the state of operation of semiconductor processor 204 utilizing instructions or information from semiconductor processor controller 228. Once semiconductor processor 204 is in an operating condition intermediate times $t_0$ and $t_1$ and times $t_3$ and $t_4$, process fluid system controller 226 instructs sampling system 212 to draw a sample of process fluid to determine the appropriate signature.

In general, control system 206 is configured to monitor the operation of semiconductor processor 204. Control system 206 is further configured to control sampling system 212 to draw an appropriate sample during defined periods of operation of semiconductor processor 206 wherein the process fluid is in a substantially homogeneous state. During other monitoring operations, it is preferred to draw samples of the process fluid during idle periods of time such as at time $t_2$, or at other periods of time during the operation of semiconductor processor 204.

Referring to FIG. 21, details of an exemplary flush system 216 are illustrated. Flush system 216 is coupled with distributor 214 and recirculation system 218 of process fluid system 202, and drain system 222 of semiconductor processor 204. Flush system 216 is coupled directly with process chamber 220 instead of recirculation system 218 in other arrangements.

The depicted configuration of flush system 216 comprises an isolation valve 272, a rinse fluid valve 274, a metering device 276, a sensor 246 and a three-way valve 278. Connection 215 provides a supply of process fluid to flush system 216. In addition, flush system 216 is coupled with a rinse fluid source. The rinse fluid source includes a de-ionized water source in the described embodiment. Flush system 216 operates at the beginning of process cycles and at the end of process cycles of semiconductor processor 204 in the described configuration.

Connection 215 is configured to transport process fluid relative to process chamber 220 of semiconductor processor 204. Responsive to control from process fluid system controller 226, flush system 216 is configured to prime a portion of connection 215 within flush system 216 prior to processing within semiconductor processor 204. Flush system 216 is further configured to rinse the portion of connection 215 within flush system 216 following the end of a processing cycle within semiconductor processor 204.

For example, during the initiation of a processing cycle corresponding to a start-up operation of semiconductor processor 204, process fluid system controller 226 is configured to control flush system 216 to prime connection 215. Flush system 216 is configured to prime connection 215 with process fluid responsive to the start-up operation.

During priming operations responsive to a start-up operation of semiconductor processor 204, flush system 216 ensures the provision of a homogeneous process fluid within connection 215. In particular, process fluid system controller 226 operates three-way valve 278 to couple connection 215 with drain system 222 of semiconductor processor 204. Thereafter, isolation valve 272 is opened and rinse fluid valve 274 is closed. Process fluid flows through connection 215 and into drain system 222.

As described above, settling of particulate matter can occur during idle periods of operation of semiconductor processor 204. Therefore, it desired to flow process fluid through connection 215 until the process fluid reaches a desired homogeneous mixture inasmuch as the use of process fluid before it has reached a homogeneous state often results in undesirable processing.

Thus, process fluid system controller 226 operates valve 278 to couple connection 215 with drain system 222 of semiconductor processor 204. Metering device 276 flows process fluid from distributor 214 through connection 215 into drain system 222. During such flowing, sensor 246 is configured to monitor the turbidity of the process fluid. Sensor 246 is coupled with process fluid system controller 226 which compares the output voltage of sensor 246 with a desired voltage corresponding to a desired turbidity of the process fluid. Once the desired turbidity is obtained within the flowing process fluid as indicated by sensor 246, process fluid system controller 226 operates valve 278 to couple connection 215 with process chamber 220. Thereafter, the processing of semiconductor workpieces is begun with the utilization of homogeneous process fluid.

Sensor 246 is also utilized to provide turbidity information during processing of workpieces within semiconductor processor system 200. The utilization of sensor 246 enables monitoring of operations of system 200 and components therein in general. For example, if valve 274 is defective and leaks rinse fluid during normal processing operations wherein rinse fluid is not utilized, such is detected using sensor 246. Process fluid system controller 226 alarms semiconductor processor controller 228 of such diluted process fluid and processing is halted immediately. Sensors 246 located throughout semiconductor processor system 200 also provide monitoring of processing operations and control system 206 provides alarming of inappropriate process conditions.

Flush system 216 is utilized in the described embodiment during halt operations of semiconductor processor 204. More specifically, control system 206 is configured to control flush system 216 to rinse connection 215 responsive to a halt operation within semiconductor processor 204.

In the described arrangement, semiconductor processor controller 228 instructs process fluid system controller 226 that semiconductor processor 204 is entering a halt operation. Responsive to semiconductor processor 204 entering a halt state of operation, process fluid system controller 226 again couples connection 215 with drain system 222 of semiconductor processor 204 using valve 278. Process fluid system controller 226 also closes isolation valve 272 and opens rinse fluid valve 274. Metering device 276 provides rinse fluid through connection 215 and into drain system 222. Such is preferably utilized to rinse connection 215 of process fluid to avoid the settling of particulate matter within connection 215 during idle periods of operation.

During such rinsing operations, process fluid system controller 226 monitors the turbidity of fluid passing through connection 215 using sensor 246. Once the turbidity falls below a certain value (indicating a desired clarity of fluid within connection 215), process fluid system controller 226 instructs rinse fluid valve 274 to close and ceases rinsing operations.

Process fluid system controller 226 thereafter awaits reception of a start-up command to again initiate the priming operations of connection 215. Such monitoring of the turbidity of the fluid within connection 215 during flushing (e.g., priming, rinsing) operations is advantageous inasmuch as flushing is ended immediately following an indication that the turbidity of the fluid within connection 215 has reached a desired range. This described operation advantageously avoids excessive flushing for determined periods of time which typically occurs in conventional systems and wastes process fluids or other fluids.

Figure 22:
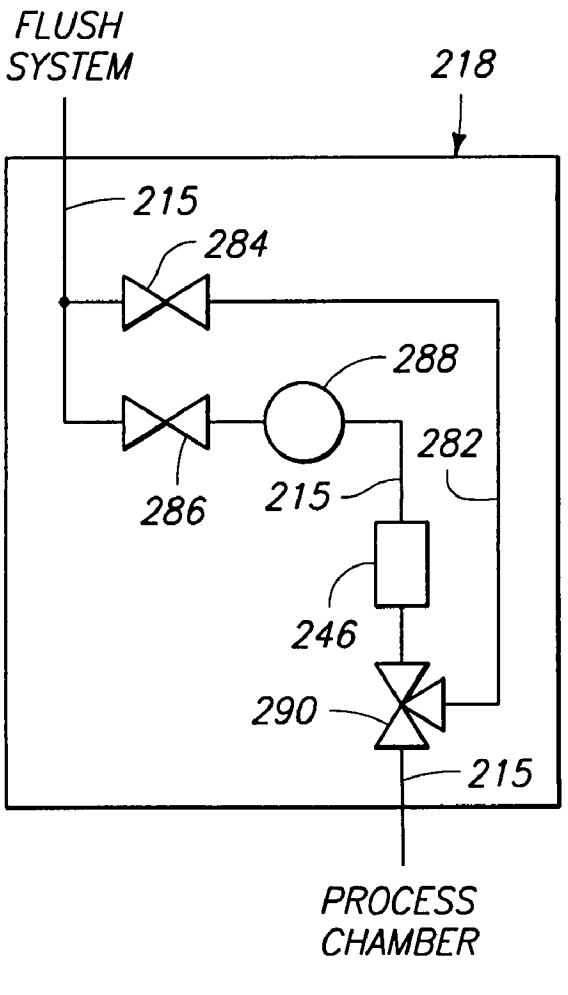
FIG. 22 is a functional representation of an exemplary recirculation system of the semiconductor processor system.

Referring to FIG. 22, an exemplary configuration of a recirculation system 218 is depicted. The depicted recirculation system 218 is coupled with distributor 214 via flush system 216. Recirculation system 216 is further coupled with process chamber 220 of semiconductor processor 204. In an alternative embodiment, recirculation system 218 is coupled to receive process fluid directly from distributor 214.

Recirculation system 216 includes a recirculation route 282 coupled with connection 215. Recirculation system 218 additionally includes a recirculation valve 284, an isolation valve 286, a metering device 288, a sensor 246 and a three-way valve 290. As described above, during idle periods of operation of semiconductor processor 204, particulate matter within the process fluid may settle within connection 215. Upon a start-up operation, application of such process fluid to process chamber 220 may result in undesirable processing of semiconductor workpieces.

Recirculation system 218 is operable to recirculate process fluid within connection 215 to a proper homogeneous level before application to process chamber 220. Control system 206, including process fluid system controller 226, is configured in the described embodiment to control recirculation system 218 responsive to a state of operation indicated from semiconductor processor controller 228 and output signals from sensor 246. In general, process fluid system controller 226 is configured to control recirculation system 218 to recirculate the process fluid responsive to the process fluid being out of the desired turbidity specification in the described embodiment.

During normal operations wherein process fluid flows through connection 215, recirculation valve 284 is closed and isolation valve 286 is opened. Metering device 288 operates to pump process fluid from distributor 214 (or flush system 216, if provided) to process chamber 220 through sensor 246 and three-way valve 290 positioned to couple connection 215 with process chamber 220.

Following a halt in operation of semiconductor processor 204, isolation valve 286 is closed. In addition, three-way valve closes the coupling of connection 215 with process chamber 220. Particulate matter typically precipitates from the process fluid within connection 215 resulting in the process fluid being out of specification during halt operations.

Upon the reception of a start-up indication from semiconductor processor controller 228, it is desired to provide homogeneous process fluid. In the described embodiment, process fluid system controller 226 initiates a recirculation procedure utilizing recirculation system 218. In such a recirculation operation, recirculation valve 284 is opened and three-way valve 290 couples connection 215 with recirculation route 282. Metering device 288 operates to pump process fluid through connection 215 and recirculation route 282.

Sensor 246 monitors process fluid flowing within connection 215. In the described embodiment, sensor 246 is configured to monitor the turbidity of such process fluid. Process fluid system controller 226 monitors the turbidity of the process fluid during the recirculation operations. Following an indication from sensor 246 that the turbidity of the process fluid is within the desired specification (i.e., has reached the appropriate homogeneous mixture), process fluid system controller 226 instructs recirculation system 218 to cease recirculation operations and to apply the process fluid from connection 215 to process chamber 220. More specifically, recirculation valve 284 is closed and three-way valve 290 is provided to couple connection 215 with so process chamber 220 responsive to control from process fluid system controller 226.

Figure 23:
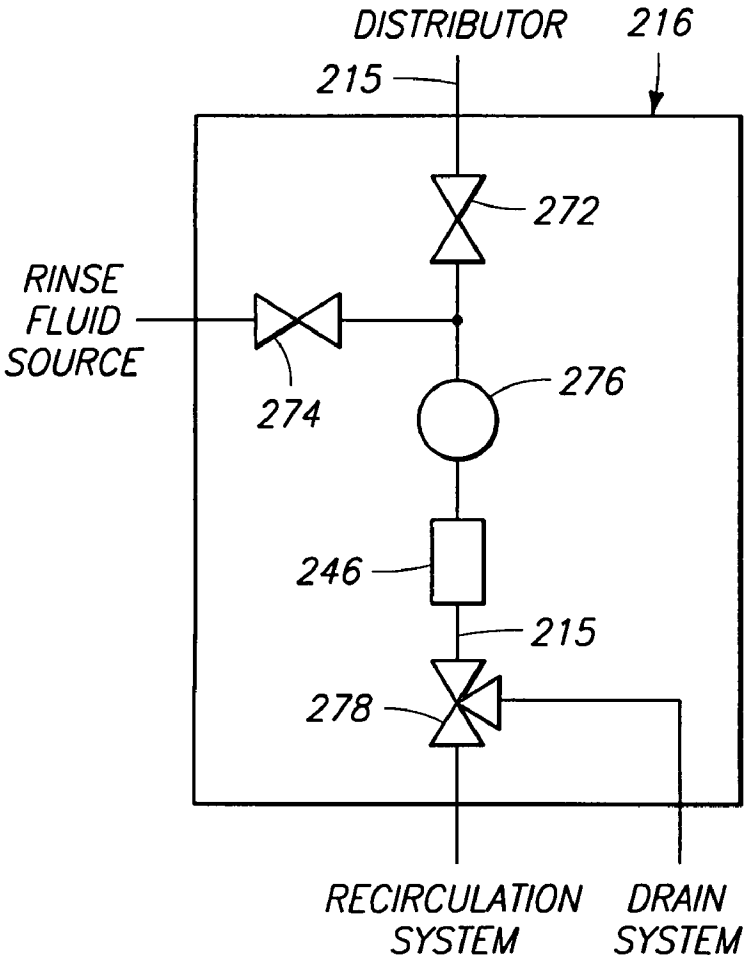
FIG. 23 is an illustrative representation of another exemplary configuration of the process chamber of the semiconductor processor system.
Figure 23:
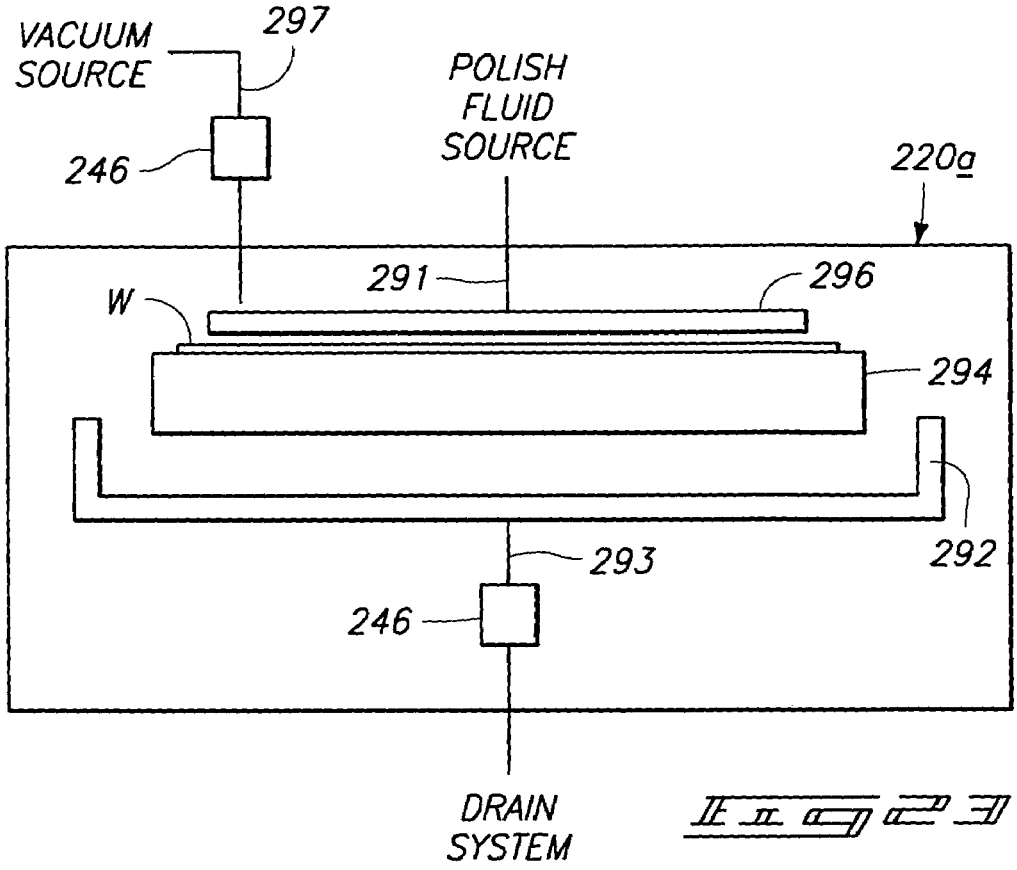

Referring to FIG. 23, an alternative configuration of process chamber **220*a* is illustrated. Process chamber 220*a* depicted in FIG. 23 includes a drain collection area 292, a table 294 and a pad 296. A connection 291 couples a polish fluid source with pad 296. In the described configuration of process chamber 220*a***, the polish fluid comprises a nonparticulate polishing fluid.

Pad 296 is a fixed abrasive or slurry generating pad in the depicted configuration of process chamber **220*a*. Table 294 is configured to support a semiconductor workpiece W. At least one of table 294 (and semiconductor workpiece W) and pad 296 are configured to rotate with respect to one another to provide processing of the semiconductor workpiece W. Polish fluid is applied to semiconductor workpiece W during such rotation. Abrasives or particulates within pad 296** are released responsive to the application of the polishing fluid and rotation against semiconductor workpiece W to provide the processing.

Such generates a process fluid which is collected within drain collection area 292. The process fluid passes through a connection 293 to drain system 222. Connection 293 couples drain collection area 292 with drain system 222. Sensor 246 is positioned to monitor process fluids passing through connection 293.

In addition, a connection 297 is provided adjacent pad 296. Connection 297 is coupled with a vacuum source, such as a pump, as which acts to extract or draw a portion of the generated process fluid from pad 296. The drawn process fluid includes particulate matter from pad 296 released during the processing of semiconductor workpiece W. Sensor 246 coupled with connection 297 is configured to monitor the turbidity of the process fluid drawn from pad 296.

As previously mentioned, sensor 246 coupled with connection 293 is configured to monitor process fluid passing through connection 293. Such fluid can contain particulate matter from pad 296, portions of semiconductor workpiece W removed during the processing procedures, polish fluid supplied via connection 291 and other matter.

Fluid drawn within connection 297 is typically free of contaminants such as portions of semiconductor workpiece W which may break during the processing thereof. Fluid drawn from pad 296 within connection 297 typically indicates the status of the process fluid during processing of semiconductor workpiece W.

As mentioned, sensors 246 are configured to monitor the turbidity of fluids passing through respective connections 293, 297. In effect, control system 206 processes signals from sensors 246 to monitor processing of a semiconductor workpiece within process chamber 220. Such monitoring indicates abnormal particle generation resulting from under or over pad wear. In addition, sensor 246 coupled with drain connection 293 may detect pieces of semiconductor workpiece W indicating workpiece breakage.

Semiconductor processor controller 228 monitors sensors 246 coupled with connections 293, 297 and controls operations within process chamber 220*a* responsive to such signals. For example, if breakage of semiconductor workpiece W is indicated as detected by sensor 246 coupled with connection 293, processing is halted and process chamber 220*a* is analyzed for faulty operation.

Figure 24:
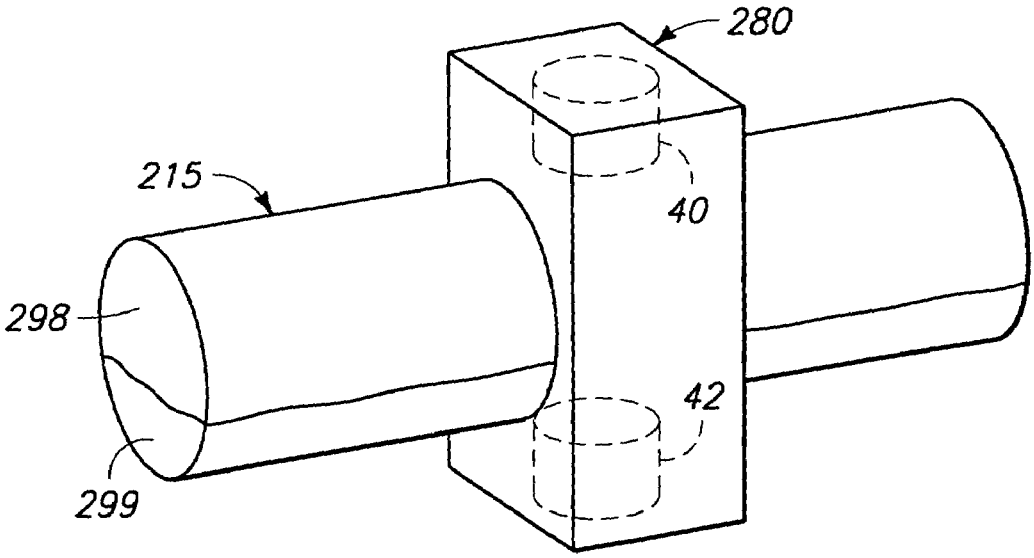
FIG. 24 is an isometric view of a connection within the semiconductor processor system.

Referring to FIG. 24, one exemplary configuration of a sensor 280 is illustrated with respect to connection 215. Although FIG. 24 is described with reference to connection 215, the operation of sensor 280 is applicable to other connections.

In the depicted configuration, sensor 280 is implemented as a configuration of sensor 26 described above with reference to FIG. 4. More specifically, the depicted sensor 280 includes source 40 configured to emit electromagnetic energy and receiver 42 configured to receive the electromagnetic energy. As described above, such is utilized to provide a turbidity indication of process fluid flowing within connection 215.

The arrangement of sensor 280 shown in FIG. 24 is configured to output a signal indicative of accumulation of particulate matter within connection 215. During idle operations, process fluid, such as a slurry, sits idle within connection 215. Particulate matter 299 precipitates from a fluid portion 298 of the process fluid.

In the depicted arrangement, connection 215 is arranged in a substantially horizontal orientation. Such horizontally oriented connections are highly susceptible to such precipitation of particulate matter 299 as shown. The configuration of sensor 280 is arranged to monitor such accumulation of particulate matter 299 in a substantially vertical orientation with respect to connection 215. Source 40 is configured to emit electromagnetic energy downward towards receiver 42. Such provides increased sensitivity to the accumulation of particulate matter 299 within connection 215.

Sensor 280 is coupled with process fluid system controller 226 of control system 206 in the described embodiment. Process fluid system controller 226 is configured to monitor the accumulation of particulate matter 299 responsive to signals provided from sensor 280.

Following the monitoring of the accumulation of particulate matter 299, control system 206 implements various functions or operations of semiconductor processor system 200. In one embodiment, control system 206 implements such functions and operations described immediately below responsive to a signal outputted from sensor 280 dropping below a predetermined value corresponding to a predefined amount of accumulation of particulate matter in the associated connection.

For example, control system 206 selectively implements a flush operation utilizing flush system 216 to flush particulate matter 299 from connection 215. Alternatively, control system 206 selectively implements a recirculation operation utilizing recirculation system 218 if connection 215 is within such recirculation system 218. Such operations occur in the described embodiment until the process fluid is again provided in a homogeneous condition as determined by sensor 280, or alternatively, flushed to drain system 222.

Drain system 222 is coupled to an appropriate drain arrangement to remove fluids from semiconductor processor system 200. Alternatively, drain system 222 is coupled with a recapture system configured to re-use such received fluids.

Referring to FIG. 25-FIG. 29, exemplary methods of controlling functions within semiconductor processor system 200 are illustrated. In the described embodiment, storage device 234 is configured to store executable instructions to implement the depicted methods. Control system 206 retrieves such stored executable instructions and executes such instructions to perform the described control operations. The depicted methodologies are implemented in other configurations, such as hardware, in other embodiments.

Figure 25:
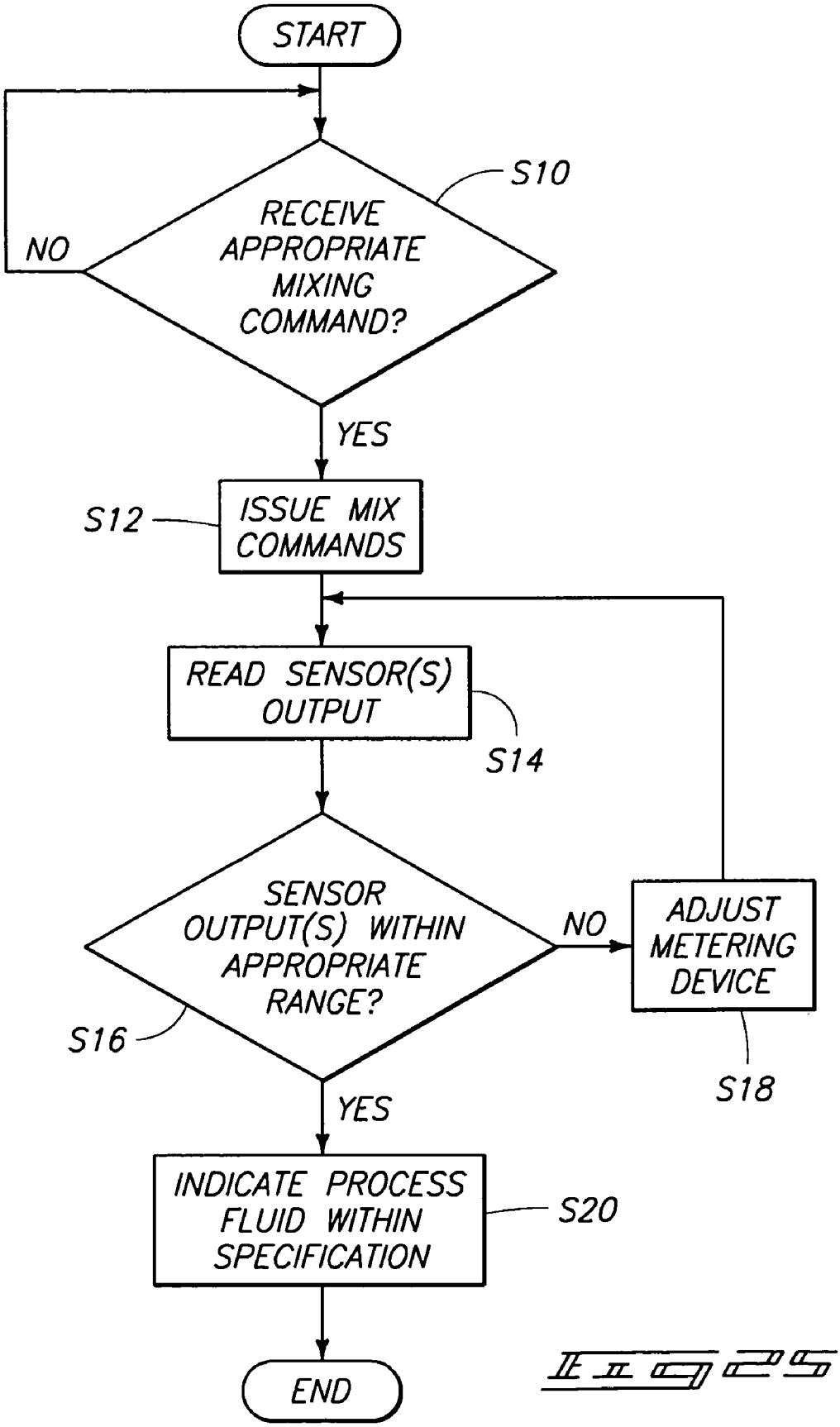
FIG. 25 is a flow chart of an exemplary method to control mixing operations of the mixing system.

Referring to FIG. 25, an exemplary methodology to control mixing operations within mixing system 210 is described. Initially, at step S10, process fluid controller 226 monitors for the reception of an appropriate mixing command. Semiconductor processor controller 228 issues such a command responsive to a start-up operation of semiconductor processor 204. Controller 226 idles at step S10 until the reception of the appropriate mixing command.

Controller 226 proceeds to step S12 following the reception of the mixing command. Process fluid system controller 226 issues mix commands during step S12. Exemplary mix commands instruct metering devices 244, 245 to pump at predefined flow rates and instruct mixer 248 to turn on.

Controller 226 then proceeds to step S14 to read output signals from one or more of sensors 246 illustrated in FIG. 16.

Controller 226 next proceeds to step S16 to determine whether received sensor output signals are within an appropriate range. In the described embodiment, sensors 246 are configured to output signals indicative of turbidity of material passing through an associated 19 connection as described above. If the output from sensors 246 are not within an appropriate range, controller 226 proceeds to step S18.

At step S18, controller 226 issues commands to adjust metering devices 244, 245. Such adjustment of metering devices 244, 245 adjusts the flow rates of one or more of the components utilized to form the process fluid.

Thereafter, controller 226 proceeds again to step S14 to read sensor output signals and then proceeds to step S16 to determine whether the sensor output is within the appropriate range.

Controller 226 proceeds to step S20 responsive to the output signals form the sensors being within the desired appropriate range as determined at step S16. At step S20, controller 226 indicates that the process fluid is within a desired specification. Such indication is applied to semiconductor processor controller 228 to initiate processing of semiconductor workpieces.

Figure 26:
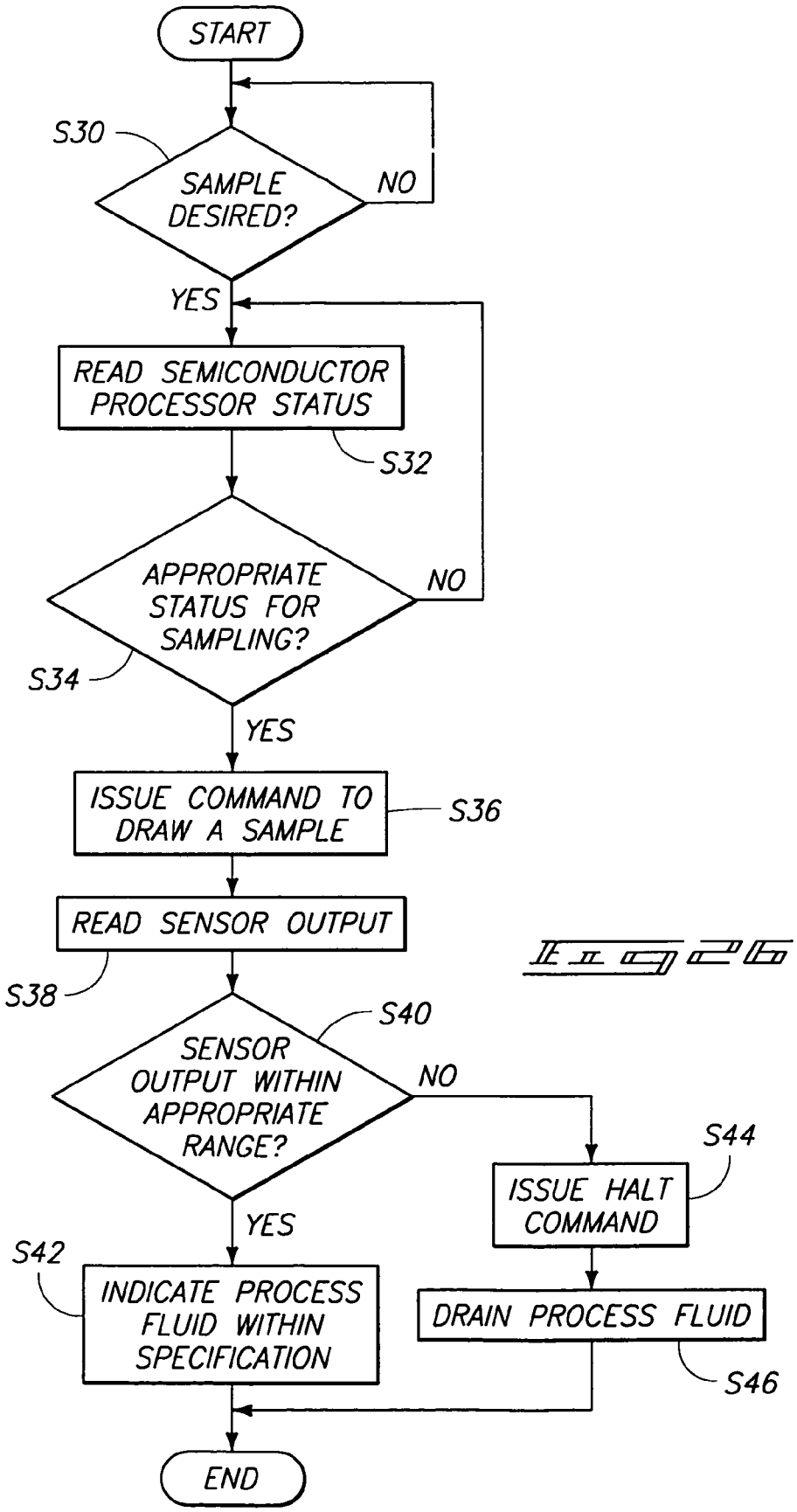
FIG. 26 is a flow chart of an exemplary method to control sampling operations of a sampling system of the semiconductor processor system.

Referring to FIG. 26, an exemplary methodology to control operations of sampling system 212 using process fluid system controller 226 is illustrated.

Initially, at step S30, controller 226 determines whether a sample of process fluid is desired. Samples are taken on a period basis or responsive to a command from interface 232 or semiconductor processor controller 228 in one embodiment. Controller 226 idles at step S30 until it is indicated that a sample is desired.

Next, controller 226 proceeds to step S32 to read semiconductor processor status (e.g., operational state of semiconductor processor 204) from controller 228.

At step S34, controller 226 determines whether the status determined at step S32 is appropriate for sampling. In some arrangements, it is desired to receive a sample when the process fluid is in a homogeneous state as described above with reference to FIG. 20. Controller 226 idles at step S34 until the desired status is correct.

Controller 226 then proceeds to step S36 to issue a command to draw a sample of process fluid responsive to semiconductor 204 being within a proper operating state. Valve 24 shown in FIG. 2 is opened responsive to step S36 to receive the sample in one configuration.

Controller 226 then proceeds to step S38 to read sensor output from an appropriate sensor following the drawing of the sample.

At step S40, controller 226 determines whether the sensor output is within an appropriate range. The analyzed range comprises an acceptable turbidity range in the described operation.

If so, controller 226 proceeds to step S42 to indicate that the process fluid is within desired specification. Such may be indicated to controller 228 to initiate or continue processing of semiconductor workpieces.

If the sensor output is not within an appropriate range as determined at step S40, controller 226 proceeds to step S44 and issues a halt command to controller 228. Thereafter, controller 226 issues a command to drain process fluid from sampling system 212. The depicted methodology of FIG. 26 is repeated until a sample is drawn which is within the appropriate desired range.

Figure 27:
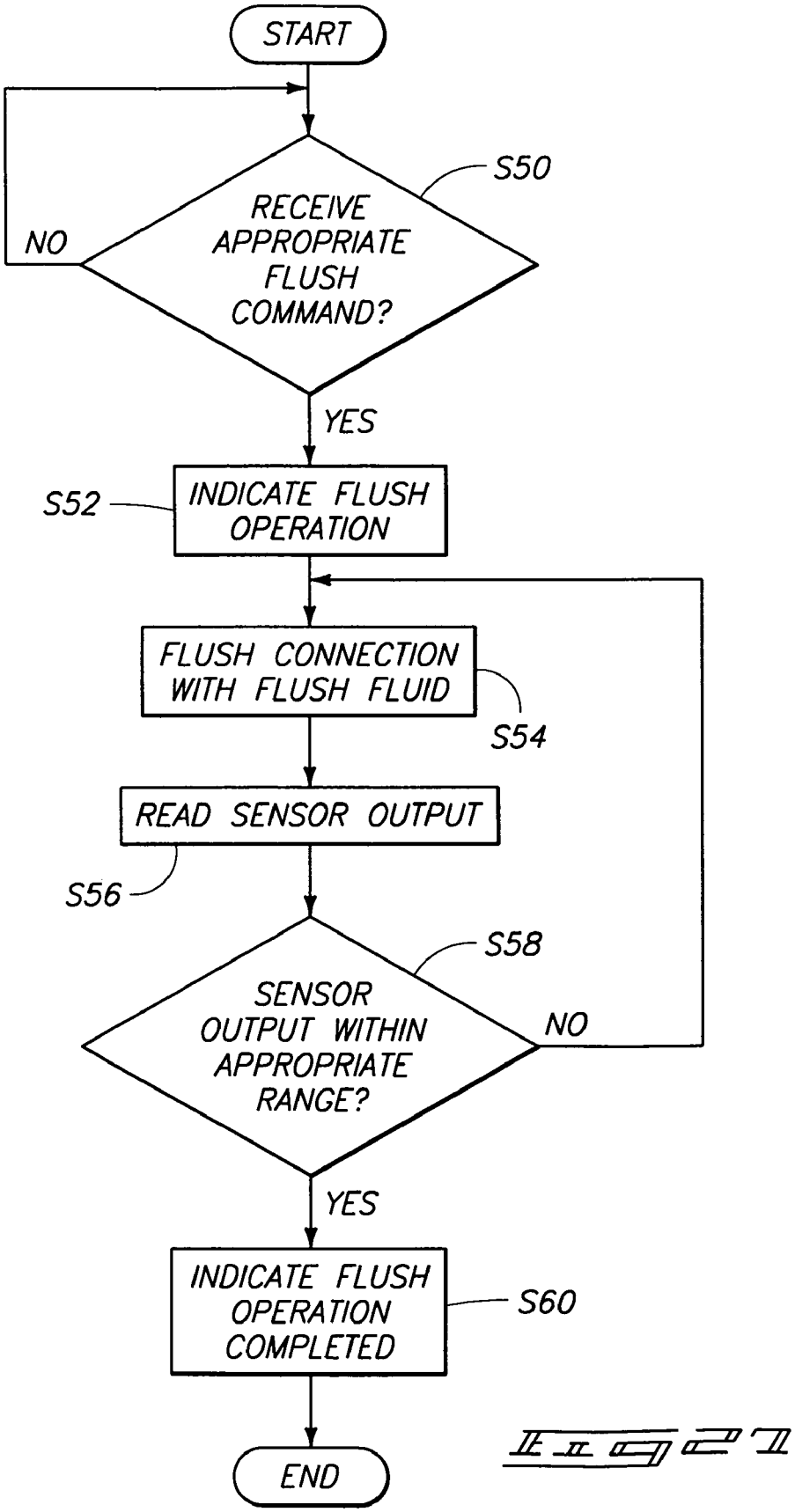
FIG. 27 is a flow chart of an exemplary method to control flush operations of the flushing system.

Referring to FIG. 27, an exemplary methodology to control flush system 216 using process fluid system controller 226 is illustrated.

Initially, controller 226 proceeds to step S50 to determine whether an appropriate flush command has been received. Such flush command is triggered responsive to a start-up command in one configuration. Controller 226 idles at step S50 until reception of the appropriate flush command.

Thereafter, controller 226 proceeds to step S52 to indicate the performance of a flush operation. Such indication is provided to controller 228 and interface 232 in the described methodology.

Thereafter, controller 226 proceeds to step S54 to initiate flushing of an appropriate connection with flush fluid. In particular, controller 226 issues commands to components of flush system 216 to implement priming and/or rinsing of the appropriate connection.

Controller 226 then proceeds to step S56 to read sensor output from flush system 216.

At step S58, controller 226 determines whether the received sensor output is within an appropriate desired range. The analyzed range comprises an acceptable turbidity range in the described embodiment.

If not, controller 226 returns to perform steps S54, S56, S58 again until the sensor output is within an appropriate range.

Controller 226 then proceeds to step S60 to indicate that the flush operation is completed. Such indication is provided to controller 228 and interface 232. Subsequent processing or operations of semiconductor processor system 200 continue following the execution of step S60.

Figure 28:
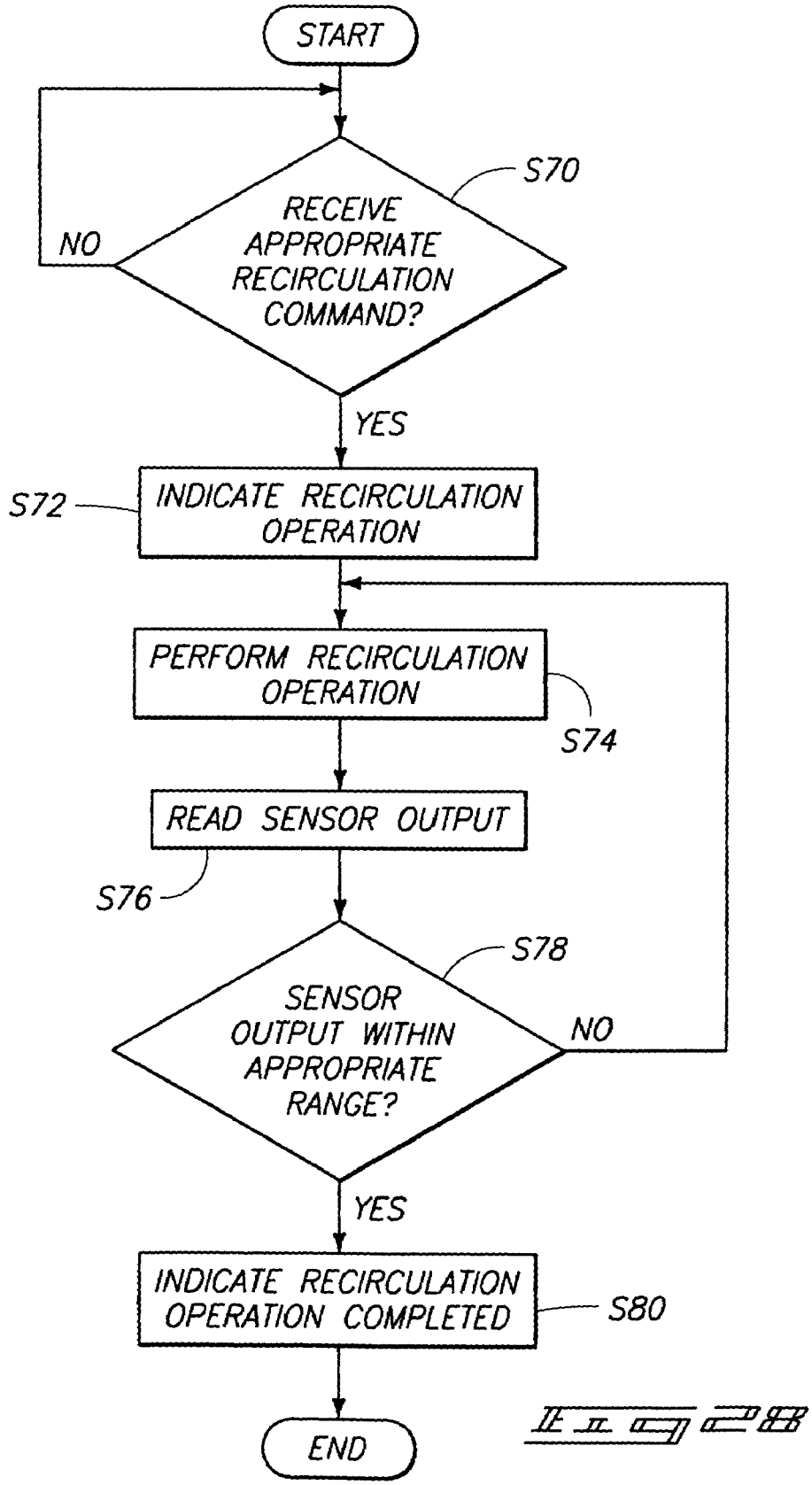
FIG. 28 is a flow chart of an exemplary method to control recirculation operations of the recirculation system.

Referring to FIG. 28, an exemplary methodology is depicted for control of recirculation system 218 by process fluid system controller 226.

Initially, controller 226 proceeds to step S70 to determine whether an appropriate recirculation command has been received. Such recirculation command is triggered following a period of inactivity of semiconductor processor 204 according to the described configuration. Controller 226 idles at step S70 until reception of an appropriate recirculation command.

Thereafter, controller 226 proceeds to step S72 to indicate the performance of a recirculation operation. Such indication is provided to controller 228 and interface 232 in the described methodology.

Controller 226 next proceeds to step S74 to initiate recirculation of process fluid within recirculation system 218. In particular, controller 226 issues commands to components of recirculation system 218 to implement the recirculation operation.

Controller 226 then proceeds to step S76 to read sensor output from a sensor of recirculation system 218.

At step S78, controller 226 determines whether the received sensor output is within an appropriate desired range. The range comprises an acceptable turbidity range of a process fluid within recirculation system 218 in one embodiment.

If not, controller 226 returns to perform steps S74, S76, S78 again until the sensor output is within an appropriate range.

Controller 226 then proceeds to step S80 to indicate that the recirculation operation is completed. Such indication is provided to controller 228 and interface 232. Subsequent processing or operations of semiconductor processor system 200 continue following the execution of step S80.

Figure 29:
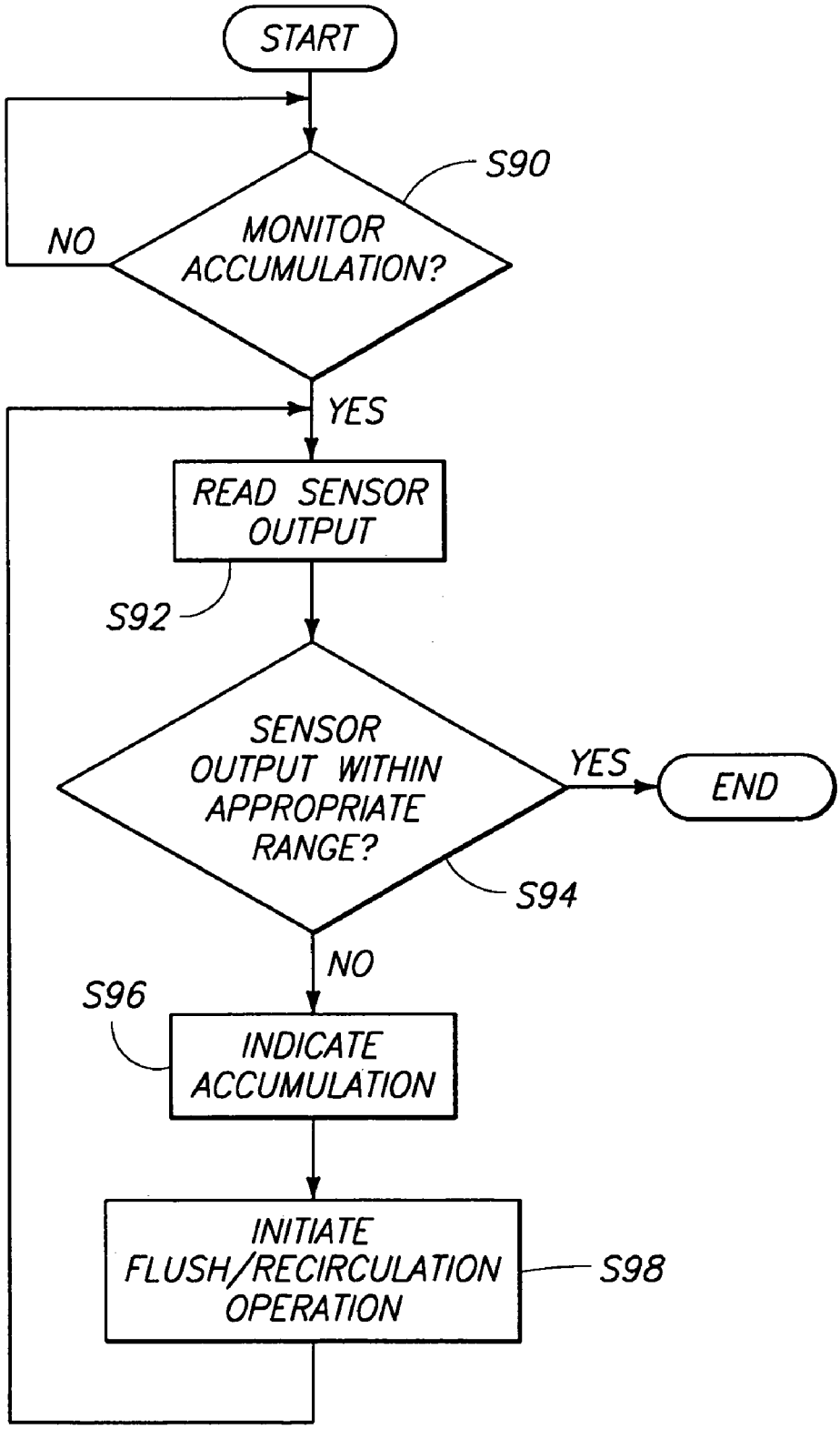
FIG. 29 is a flow chart of an exemplary method to monitor accumulation of particulate matter within a connection of the semiconductor processor system.

Referring to FIG. 29, one exemplary methodology to monitor the accumulation of particulate matter within a connection is illustrated.

Initially at step S90, controller 226 determines whether it is appropriate to monitor the accumulation of such particulate matter. Such can be a timed operation or an entered instruction from interface 232 in exemplary embodiments. Controller 226 idles at step S90 until an appropriate instruction or time-out period has elapsed.

At step S92, controller 226 reads the appropriate sensor output.

Thereafter, controller 226 proceeds to step S94 to determine whether the sensor output is within an appropriate range. The analyzed output is from a turbidity sensor in accordance with the described embodiment. No steps are taken responsive to the sensor output and any accumulation being within an acceptable range.

If the sensor output is not within an appropriate range, controller 226 proceeds to step S96 to indicate the presence of such accumulation. Such indication is provided to controller 228 and interface 232 in the described embodiment.

At step S98, controller 226 initiates a flush and/or recirculation operation to clear the accumulated particulate matter within the associated connection.

Controller 226 then returns to step S92 and again reads the appropriate sensor output. The depicted method is performed until the condition at step S94 is satisfied.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A semiconductor processor system comprising:

a process chamber adapted to process at least one semiconductor workpiece using a process fluid;

a connection coupled with the process chamber and configured to receive the process fluid and to supply the process fluid to the process chamber;

a sensor configured to output signals indicative of turbidities of fluids within the connection;

a flush system coupled with the connection and configured to selectively flush the connection; and a control system coupled with the sensor and configured to control at least one operation of the flush system with respect to flushing the connection using the signals.

2. The system according to claim 1 wherein the connection comprises a connection of a sampling system configured to provide the process fluid in a substantially static state.

3. The system according to claim 2 wherein the control system is configured to compare the substantially static process fluid with a signature to determine at least one characteristic of the process fluid.

4. The system according to claim 3 wherein the control system is configured to control a flow rate of the process fluid into the process chamber responsive to the comparison.

5. The system according to claim 4 wherein the control system is configured to halt processing within the process chamber responsive to the comparison.

6. The system according to claim 1 wherein the sensor is configured to output a signal indicative of accumulation of particulate matter within the connection.

7. The system according to claim 1 wherein the control system is configured to process the signal to monitor processing of the at least one semiconductor workpiece within the process chamber.

8. The system according to claim 1 wherein the flush system is configured to flush the connection with at least one of the process fluid and a rinse fluid.

9. The system according to claim 1 wherein the flush system is configured to flush the connection responsive to control from the control system.

10. The system according to claim 1 further comprising a mixing system configured to mix plural components of the process fluid and the control system is configured to control the mixing system.

11. The system according to claim 1 further comprising a storage device configured to store historical data corresponding to the process fluid.

12. The system according to claim 1 wherein the process chamber comprises a process chamber of a chemical-mechanical polishing processor.

13. A semiconductor processor system comprising:

a process chamber adapted to process at least one semiconductor workpiece using a process fluid;

a connection coupled with the process chamber and configured to transport the process fluid;

a sampling system coupled with the connection and configured to receive a sample of the process fluid;

a sensor coupled with the sampling system and configured to output a signal indicative of turbidity of the sample of the process fluid; and a control system coupled with the sensor and configured to control at least one operation of the semiconductor processor system responsive to the signal;

wherein the sample of the process fluid is in a substantially static state in the sampling system;

wherein the control system is configured to compare the signal with a signature to determine at least one characteristic of the process fluid; and wherein the control system is configured to control a flow rate of the process fluid into the process chamber responsive to the comparison.

14. The system according to claim 13 wherein the sensor is configured to monitor a percentage of solids present in a liquid of the process fluid to provide information regarding the turbidity of the process fluid.

15. The system according to claim 13 wherein the control system is configured to control the sampling system to draw the sample of the process fluid.

16. The system according to claim 13 wherein the control system is configured to monitor operation of the semiconductor processor system and to control the sampling system to draw the sample during defined operations of the semiconductor processor system.

17. The system according to claim 13 further comprising a storage device coupled with the sensor and configured to store historical data corresponding to the process fluid.

18. The system according to claim 13 wherein the process chamber comprises a process chamber of a chemical-mechanical polishing processor.

19. A semiconductor processor system comprising:

a process chamber adapted to process at least one semiconductor workpiece using a process fluid;

a process fluid system including:

a connection coupled with the process chamber and configured to transport process fluid relative to the process chamber;

a flush system configured to flush the connection using a flush fluid; and a sensor coupled with the flush system and configured to output a signal indicative of the turbidity of the flush fluid;

a control system coupled with the sensor and configured to control the flush system to prime the connection using the flush fluid comprising the process fluid responsive to a start-up operation of the semiconductor processor system and to control the flush system to provide the process fluid used to prime the connection to a drain until the turbidity of the process fluid used to prime the connection is acceptable and to thereafter provide the process fluid to the process chamber responsive to the turbidity of the process fluid being acceptable.

20. The system according to claim 19 wherein the control system is configured to control the flush system to rinse the connection responsive to a halt operation of the semiconductor processor system.

21. The system according to claim 20 wherein the flush system is configured to rinse the connection with flush fluid comprising rinse fluid responsive to the halt operation.

22. The system according to claim 19 wherein the process fluid system is configured to supply process fluid to the process chamber.

23. The system according to claim 19 wherein the process chamber comprises a process chamber of a chemical-mechanical polishing processor.

24. A semiconductor processor system comprising:

a process chamber adapted to process at least one semiconductor workpiece using a process fluid;

a connection configured to transport the process fluid relative to the process chamber;

a sensor coupled with the connection and configured to output a signal indicative of accumulation of particulate matter within the connection;

a control system coupled with the sensor and configured to monitor the accumulation using the signal; and a flush system configured to flush the connection and wherein the control system is configured to control the flush system using the monitoring of the accumulation.

25. The system according to claim 24 wherein the connection is arranged in a substantially horizontal orientation.

26. The system according to claim 25 wherein the sensor is arranged to monitor accumulation in a substantially vertical orientation with respect to the connection.

27. The system according to claim 25 wherein the connection comprises a pipe and the sensor is configured to output the signal indicative of the accumulation of particulate matter within the connection which is not suspended in fluids present within the connection and which is supported by a wall of the connection.

28. The system according to claim 24 further comprising a recirculation system configured to recirculate process fluid within the connection and wherein the control system is configured to control the recirculation system responsive to monitoring the accumulation.

29. The system according to claim 24 wherein the connection comprises a supply pipe configured to provide process fluid to the process chamber.

30. The system according to claim 24 wherein the connection comprises a drain connection configured to receive process fluid from the process chamber.

31. The system according to claim 24 wherein the sensor is configured to monitor turbidity of the process fluid.

32. The system according to claim 24 wherein the process chamber comprises a process chamber of a chemical-mechanical polishing processor.

33. The system according to claim 24 wherein gravity causes the accumulated particulate matter to accumulate within the connection.

34. The system according to claim 24 wherein the sensor is configured to output the signal indicative of accumulation of particulate matter within a portion of the connection arranged to transport the process fluid in a substantially horizontal direction.

35. The system according to claim 24 wherein the sensor is configured to output the signal indicative of the accumulation of particulate matter within the connection and which is not suspended in fluids present within the connection.

36. The system according to claim 24 wherein the connection comprises a pipe configured to transport the process fluid from a mixing system to the process chamber.

37. The system according to claim 24 wherein the control system is configured to control the flush system to flush the connection using monitoring of the accumulation of the particulate matter within the connection.

38. A semiconductor workpiece process fluid system comprising:

a connection configured to transport a semiconductor workpiece process fluid relative to a semiconductor process chamber;

a sensor oriented relative to the connection and configured to output a signal indicative of the semiconductor workpiece process fluid;

a control system coupled to receive the signal from the sensor and configured to monitor the semiconductor workpiece process fluid using the signal; and a drain coupled to the connection, and the control system is configured to control removal of at least a portion of the semiconductor workpiece process fluid from the system via the drain using the monitoring of the semiconductor workpiece process fluid.

39. The system according to claim 38 wherein the sensor is configured to output the signal indicative of turbidity of the semiconductor workpiece process fluid.

40. The system according to claim 38 wherein the control system is configured to compare the signal with a signature to monitor the semiconductor workpiece process fluid.

41. The system according to claim 38 further comprising at least one metering device configured to permit flow of a component of the semiconductor workpiece process fluid, and the control system is configured to control the metering device to control a flow rate of the component responsive to the signal.

42. The system according to claim 38 wherein the process chamber comprises a process chamber of a chemical-mechanical polishing processor.

43. A semiconductor processor system comprising:

a process chamber adapted to process at least one semiconductor workpiece using a process fluid;

a connection coupled with the process chamber and configured to receive the process fluid;

a sensor coupled with the connection and configured to output a signal indicative of the process fluid;

a control system coupled with the sensor and configured to control at least one operation of the semiconductor processor system responsive to the signal;

wherein the connection comprises a connection of a sampling system configured to provide the process fluid in a substantially static state;

wherein the control system is configured to compare the substantially static process fluid with a signature to determine at least one characteristic of the process fluid; and wherein the control system is configured to control a flow rate of the process fluid into the process chamber responsive to the comparison.

44. A semiconductor processor system comprising:

a process chamber adapted to process semiconductor workpieces using a process fluid;

a connection coupled with the process chamber and configured to receive the process fluid and to transport the process fluid to a process chamber;

a sensor coupled with the connection and configured to output signals indicative of turbidities of fluids within the connection;

a flush system coupled with the connection and configured to selectively flush the connection with a rinse fluid different than the process fluid; and a control system configured to control the flush system to cease the flushing of the connection with the rinse fluid using the signals.

45. The system according to claim 44 wherein the flush system is configured to flush the connection with the process fluid.

46. A semiconductor processor system comprising:

a process chamber adapted to process at least one semiconductorworkpiece using a process fluid;

a connection coupled with the process chamber and configured to receive the process fluid;

a sensor coupled with the connection and configured to output a signal indicative of turbidity of the process fluid;

wherein the connection comprises a connection of a sampling system configured to provide the process fluid in a substantially static state;

a control system is coupled with the sensor and configured to compare the turbidity of the substantially static process fluid with a signature to determine at least one characteristic of the process fluid;

wherein the control system is configured to control a flow rate of the process fluid into the process chamber using the comparison.

47. A semiconductor processor system comprising:

a process chamber adapted to process at least one semiconductor workpiece using a process fluid;

a connection coupled with the process chamber and configured to receive the process fluid;

a sensor coupled with the connection and configured to monitor turbidity of the process fluid and to output a signal indicative of the turbidity of the process fluid;

a flush system coupled with the connection and configured to selectively flush the connection; and a control system coupled with the sensor and configured to control at least one operation of the flush system using the signal.

48. The system of claim 47 wherein the flush system is configured to flush the connection with a rinse fluid different than the process fluid.

49. The system of claim 47 wherein the control system is configured to control the flush system to flush the connection using the signal.

50. The system of claim 47 wherein the sensor is configured to monitor a percentage of solids present within a liquid of the process fluid to monitor the turbidity of the process fluid.

51. A semiconductor processor system comprising:

a process chamber adapted to process at least one semiconductor workpiece using a process fluid;

a process fluid system including:

a connection coupled with the process chamber and configured to transport process fluid relative to the process chamber;

a flush system configured to flush the connection using a flush fluid; and a sensor coupled with the flush system and configured to output a signal indicative of the flush fluid; and a control system coupled with the sensor and configured to control the flush system to flush the connection using the signal; and wherein the control system is configured to control the flush system to rinse the connection responsive to a halt operation of the semiconductor processor system.

52. The system of claim 51 wherein the flush system is configured to rinse the connection with flush fluid comprising rinse fluid responsive to the halt operation.

53. The system of claim 51 wherein the sensor is configured to monitor turbidity of the flush fluid and the control system is configured to control the flush system using the turbidity of the flush fluid.

* * * * *

UNITED STATES PATENT AND TRADEMARK OFFICE

CERTIFICATE OF CORRECTION

PATENT NO. : 7,530,877 B1
APPLICATION NO. : 09/517127
DATED : May 12, 2009
INVENTOR(S) : Moore et al.

It is certified that error appears in the above-identified patent and that said Letters Patent is hereby corrected as shown below:

In column 27, lines 8-9, in Claim 46, delete “semiconductorworkpiece” and insert -- semiconductor workpiece --, therefor.

In column 27, line 18, in Claim 46, after “system” delete “is”.

Signed and Sealed this

Twenty-first Day of July, 2009

John Doll

JOHN DOLL
*Acting Director of the United States Patent and Trademark Office*